US006078233A

United States Patent [19]

Misumi et al.

[11] Patent Number: 6,078,233

[45] Date of Patent: Jun. 20, 2000

[54] RELAY AND MATRIX RELAY

[75] Inventors: Shuichi Misumi; Kozo Maenishi, both of Kyoto, Japan

[73] Assignee: Omron Corporation, Kyoto, Japan

[21] Appl. No.: 09/051,485

[22] PCT Filed: Oct. 16, 1996

[86] PCT No.: PCT/JP96/02990

§ 371 Date: Apr. 17, 1998

§ 102(e) Date: Apr. 17, 1998

[87] PCT Pub. No.: WO94/15062

PCT Pub. Date: Apr. 24, 1997

[30] Foreign Application Priority Data

Oct. 20, 1995 [JP] Japan ..... 7-272344
Jul. 31, 1996 [JP] Japan ..... 8-201790

[51] Int. Cl.[7] ..... H01H 67/02

[52] U.S. Cl. ..... 335/128; 257/415; 257/421

[58] Field of Search ..... 335/78–86, 124, 335/128; 257/415, 417, 418, 420, 421, 422, 428; 307/130; 361/160, 741, 819

[56] References Cited

U.S. PATENT DOCUMENTS

| | | | |
|---|---|---|---|
| 5,398,011 | 3/1995 | Kimura et al. | 335/79 |
| 5,479,042 | 12/1995 | James et al. | 257/415 |
| 5,742,015 | 4/1998 | Tai et al. | 335/78 |

FOREIGN PATENT DOCUMENTS

| | | |
|---|---|---|
| 2 532 780 | 3/1984 | France . |
| 10 81 059 | 6/1960 | Germany . |
| 25 26 030 | 1/1976 | Germany . |
| 45-30444 | 11/1970 | Japan . |
| 46-3896 | 2/1971 | Japan . |
| 63-18738 | 2/1988 | Japan . |
| 63-175310 | 7/1988 | Japan . |
| 1-60436 | 4/1989 | Japan . |
| 1-292725 | 11/1989 | Japan . |
| 2-18245 | 2/1990 | Japan . |
| 7-29473 | 1/1995 | Japan . |
| 2 186 428 | 8/1987 | United Kingdom . |

*Primary Examiner*—Lincoln Donovan
*Attorney, Agent, or Firm*—Morrison & Foerster

[57] ABSTRACT

A micro relay comprising a coil plate 40 having a spiral flat coil 48 formed around a through hole 42 on the front and rear surfaces of the plate, a fixed contact plate 50 which is tightly fixed on the upper surface of this coil plate 40 and uses a tip portion of an iron core 51 projecting from the through hole 42 as a fixed contact 52 and a movable contact plate 20 which makes a movable contact piece 23 pivotally supported in the direction of plate thickness via a hinge portion 22 extending from inside an annular yoke 24 face the fixed contact 52 so as to allow it to come in and out of contact with the fixed contact 52. With this arrangement, a relay of a high productivity having no scattering in operation characteristics can be obtained.

26 Claims, 18 Drawing Sheets

RELAY AND MATRIX RELAY

TECHNICAL FIELD

The present invention relates to relays, and in particular, to a subminiature relay and matrix relay constructed by stacking approximately plate-shaped components.

BACKGROUND ART

Conventionally, as a miniature relay constructed by stacking approximately plate-shaped components, there is, for example, the relay disclosed in the document of Japanese Patent Laid-Open Publication No. HEI 1-292725.

The relay is characterized in that it comprises a base board having two fitting holes and at least two print coil portions which are formed so as to be printed in an approximate spiral form around the fitting holes, an iron core which has an approximately bracket-like cross-section shape and has its both end portions projected while being fitted in the fitting holes, and a movable contact piece having its one end portion fixed to one projected end portion of the iron core, its middle portion arranged so as to be able to come in and out of contact with the other projected end portion of the iron core and a movable contact provided at a free end portion facing a fixed contact provided at the base board so as to be able to come in and out of contact with the fixed contact.

However, according to the aforementioned relay, the iron core and the movable contact piece must be fixed to the base board in different directions, and this requires much labor in positioning and assembling works, tending to cause a scattering in assembling accuracy. For this reason, there is a first technical problem that the productivity is low and a scattering tends to occur in the operation characteristics.

In view of the above-mentioned first technical problem, it is a primary object of the present invention to provide a relay of a high productivity causing no scattering in operation characteristics.

As a prior art matrix relay, there is, for example, the one disclosed in the document of Japanese Patent Laid-Open Publication No. HEI 7-29473.

Namely, it is constructed so that its contact is opened and closed by driving a movable spring contact provided at a band plate by means of an electromagnet array comprised of a required number of electromagnets formed by providing a solenoid wound around a fixed contact core.

However, since the aforementioned matrix relay has the electromagnets formed by providing the solenoid wound around the fixed contact core as its components, it has a limitation in compacting and particularly reducing in thickness the device.

Furthermore, since most of the components are not flat nor able to be stacked in one direction, there is a second technical problem that much labor is required for the assembly and the productivity is low.

In view of the above-mentioned second technical problem, it is a second object of the present invention to provide a subminiature matrix relay capable of being easily assembled.

DISCLOSURE OF THE INVENTION

In order to achieve the first object, a first feature of the relay of the present invention is that it comprises a coil plate having at least one layer of a spiral flat coil formed around a through hole and a movable contact and a fixed contact which face each other so as to be able to come in and out of contact with each other via the through hole of the coil plate, the movable contact being provided at a movable contact piece pivotally supported in a direction of plate thickness via at least one hinge portion extending from inside an annular yoke for the formation of a movable contact plate, and the fixed contact being provided on one surface of a plate-like material for the formation of a fixed contact plate.

According to the first feature of the present invention, there is a layer structure in which the constituent members are assembled so as to be stacked in the vertical direction, and therefore, the assembling can be achieved easier and the assembling accuracy is higher than in the prior art. Therefore, a thin type relay having no scattering in operation characteristic can be obtained.

In particular, when a fixed contact plate is formed by providing the fixed contact at the plate-shaped magnetic material, this can be concurrently used as an iron core. On the other hand, since the yoke and the movable contact piece are integrated with each other, there are reduced numbers of components and assembly processes, leading to a high productivity.

Furthermore, when the fixed contact plate is formed by providing the fixed contact at the plate-shaped magnetic material, the coil plate is positioned between the fixed contact plate and the annular yoke, and therefore, the leak of the magnetic flux reduces, allowing a relay having a high magnetic efficiency to be obtained.

A second feature of the present invention is that the movable contact plate is constructed so that the hinge portion is formed by providing a thin plate made of a conductive magnetic material with a slit having a C-figured planar shape, and the movable contact piece is divided from the annular yoke by the slit.

According to the second feature, the movable contact plate is formed of a thin plate comprised of one conductive magnetic material, and therefore, a relay of an inexpensive component cost having a high component accuracy and a high assembling accuracy can be obtained.

A third feature is that a supplementary yoke is held between the yoke of the movable contact plate and the coil plate.

According to the third feature, with the provision of the supplementary yoke, the magnetic efficiency can be increased and a pivoting space of the movable contact piece can be secured, and this obviates the need for subjecting the movable contact piece to a bending process, increases the component accuracy and reduces the number of processes.

A fourth feature is that an inner diameter of the supplementary yoke is greater than an outer diameter of the movable contact piece and smaller than an inner diameter of the yoke.

According to the fourth feature, the inner peripheral edge portion of the supplementary yoke and the outer peripheral edge portion of the movable contact piece come close to each other, so that the magnetic resistance is reduced to allow a relay having a high sensitivity to be obtained.

A fifth feature is that the yoke of the movable contact plate is thicker than the movable contact piece and the hinge portion.

According to the fifth feature, a relay which has no need for providing a separate supplementary yoke and has reduced numbers of components and assembly processes can be obtained.

A sixth feature is that the hinge portion is made to be a portion having a reduced thickness.

A seventh feature is that the hinge portion is provided with a through hole.

An eighth feature is that both end portions of the slit extend inside the movable contact piece so as to form an elongated hinge portion.

According to the sixth, seventh and eighth features, the movable contact piece can be made to pivot by a small external force, and therefore, a relay having a high sensitivity can be obtained.

A ninth feature is that the fixed contact plate is tightly fixed to an insulating film provided on the upper surface of the coil plate, and a yoke of the movable contact plate is tightly fixed to an insulating film provided on the lower surface of the coil plate.

A tenth feature is that the fixed contact plate is tightly fixed to the insulating film provided on the upper surface of the coil plate, and the yoke of the movable contact plate is tightly fixed to the insulating film provided on the lower surface of the coil plate via the supplementary yoke.

According to the ninth and tenth features, an insulating property can be secured without using any special insulating component, and the positional relation between the iron core and the yoke or the supplementary yoke is determined by managing the thickness dimension of the coil plate, so that the operation is stabilized.

An eleventh feature is that a lower surface edge portion of the coil plate is integrated by bonding with an upper surface edge portion of a box-shaped base, and the movable contact plate is housed in a sealed space formed by sealing the through hole of the coil plate with the fixed contact plate.

A twelfth feature is that an insulating film is provided on a surface which belongs to the lower surface of the fixed contact plate and is bonded to the coil plate, and the coil plate and a box-shaped base are formed of a material identical to the material used for forming the insulating film.

According to the eleventh and twelfth features, a sealed structure can be formed, and therefore, any corrosive gas, foreign material and the like can be prevented from entering. Furthermore, the insulating property can be improved by forming a high vacuum or filling a gas or liquid having a high insulating property in the sealed space.

A thirteenth feature is a construction comprising a box-shaped base where a movable contact terminal is exposed from its bottom corner portion and a coil terminal and an upper end portion of a fixed contact terminal are exposed from its upper surface edge portion, a movable contact plate which is housed in the box-shaped base and electrically connected to the movable contact terminal, a coil plate which is tightly fixed to the upper surface edge portion of the box-shaped base and has a flat coil electrically connected to an upper end portion of the coil terminal, and a fixed contact plate which is tightly fixed to an upper surface of the coil plate, has an iron core projected on its lower surface through a through hole of the coil plate and is electrically connected to an upper end portion of the fixed contact terminal.

According to the thirteenth feature, the components can be assembled in an identical direction, and this facilitates the assembling, and in particular, automatic assembling.

Furthermore, the movable contact piece is positioned at the bottom surface of the box-shaped base and the coil plate is provided at the upper surface edge portion of the box-shaped base. Therefore, an insulating distance between the flat coil and the movable contact piece can be secured.

A fourteenth feature is that the coil terminal and the upper end portion of the fixed contact terminal projecting from the upper surface edge portion of the boxshaped base are electrically connected in an engagement manner respectively to a corresponding terminal hole and a corresponding cut portion provided at the coil plate and the fixed contact plate.

According to the fourteenth feature, the upper end portion of the coil terminal and the fixed contact terminal are projecting from the upper surface edge portion of the box-shaped base. Therefore, these members can be positioned while being engaged with the terminal hole or the cut portion provided at the coil plate and the fixed contact plate, respectively, thereby further facilitating the assembling work.

A fifteenth feature is that the upper end portion of the coil terminal and the fixed contact terminal are exposed in flush with each other from the upper surface edge portion of the box-shaped base, the coil plate is electrically connected to the upper end portion of the coil terminal while being stacked on the coil terminal and the upper end portion of the fixed contact terminal is electrically connected to the fixed contact plate via an intermediate conductor provided at the coil plate.

According to the fifteenth feature, the manufacturing of the base is facilitated and the intermediate conductor can be formed through a process identical to that of the flat coil, therefore resulting in no cost increase.

A sixteenth feature is that the upper end portion of the coil terminal and the fixed contact terminal are exposed in flush with each other from the upper surface edge portion of the box-shaped base, the coil plate is electrically connected to the upper end portion of the coil terminal while being stacked on the coil terminal and a connecting stepped portion projected downward from an edge position of the fixed contact plate is electrically connected to the upper end portion of the fixed contact terminal while being directly bonded to the upper end portion.

According to the sixteenth feature, no intermediate conductor is required, and this provides an advantage that the reliability of the electrical connection improves.

In order to achieve the second object of the present invention, a seventeenth feature of the present invention is a matrix relay comprising a coil plate where at least one layer of a spiral flat coil is provided around a plurality of through holes provided in a matrix form on an insulative substrate, and movable contacts and fixed contacts which face each other so as to be able to come in and out of contact with each other via the through holes of the coil plate, the movable contacts being electrically connected together every row for the formation of a movable contact unit, and the fixed contacts being electrically connected together every column for the formation of a fixed contact unit.

According to the seventeenth feature, the constituent members can be stacked in the vertical direction, and therefore, a thin type matrix relay can be obtained. Particularly by arranging a plurality of flat coils in a matrix form on one coil plate, a subminiature matrix relay can be obtained.

Furthermore, approximately plate-shaped internal components can be assembled while being stacked in one direction, and therefore, a matrix relay of a high productivity for facilitated assembling is obtained.

An eighteenth feature is that the fixed contacts are each projected on a fixed contact plate and arranged at a tip portion of an iron core which serves as a projecting section capable of penetrating the through hole.

According to the eighteenth feature, the tip portion of the iron core is made to serve as a fixed contact, and therefore, the leak of the magnetic flux reduces, allowing a matrix relay having a high magnetic efficiency to be obtained.

A nineteenth feature is that the movable contacts are provided at movable contact pieces provided parallel on the movable contact plate and are each arranged at a tip portion of a projecting section which can penetrate the through hole.

According to the nineteenth feature, the tip portion projecting from the movable contact piece is made to serve as a movable contact, and this facilitates the extruding work of the fixed contact to be brought in contact with this, therefore improving the productivity.

A twentieth feature is that a supplementary yoke plate which is made of a magnetic material having a planar shape identical to that of the movable contact plate and is provided with a through hole slightly larger than that of the movable contact piece in a position corresponding to the movable contact piece is held between the movable contact plate and the coil plate.

According to the twentieth feature, the supplementary yoke plate is held between the movable contact plate and the coil plate, and therefore, the leak of the magnetic flux reduces, allowing a matrix relay having a high magnetic efficiency to be obtained.

A twenty-first feature is that the flat coil is connected to common connection lines which are provided parallel at a specified pitch on front and rear surfaces of the coil plate and cross in a matrix form.

According to the twenty-first feature, a plurality of flat coils are connected to a common connection line, thereby allowing a plurality of circuits to be concurrently opened and closed.

A twenty-second feature is that a return delay element is connected parallel to each flat coil of the coil plate.

According to the twenty-second feature, the attenuation of the excitation current is delayed by the return delay element, and therefore, the individual switches can be arbitrarily opened and closed by a prior art control method.

A twenty-third feature is that the flat coil of the coil plate is connected to the common connection line via reverse current preventing element connected in series with the flat coil.

According to the twenty-third feature, only the desired switch can be opened and closed by the reverse current preventing element, thereby allowing the reliability of the operation characteristic to be improved.

A twenty-fourth feature is that the movable contact plates is fitted in each of a plurality of recessed portions arranged parallel on an upper surface of a base and one end portion of the movable contact plate is connected to a connecting end portion of the movable contact terminal exposed from a bottom corner portion of the recessed portion.

A twenty-fifth feature is that a coil terminal use connecting portion of the common connection line provided at a lower surface peripheral portion of the coil plate is connected to a connecting end portion of a coil terminal exposed at a specified pitch from an upper surface peripheral portion of the base.

A twenty-sixth feature is that one end portion of the fixed contact plate is connected to a connecting end portion of a fixed contact terminal exposed at a specified pitch from an upper surface peripheral portion of the base.

According to the twenty-fourth, twenty-fifth and twenty-sixth features, the movable contact plate, the coil plate and the fixed contact plate can be connected while being stacked from above on the base, and this provides an advantage that a matrix relay having a high productivity can be obtained.

BEST MODE FOR CARRYING OUT THE INVENTION

Embodiments of the relay and matrix relay of the present invention will be described below with reference to the accompanying drawings of FIG. 1 through FIG. 18B.

Figure 1:
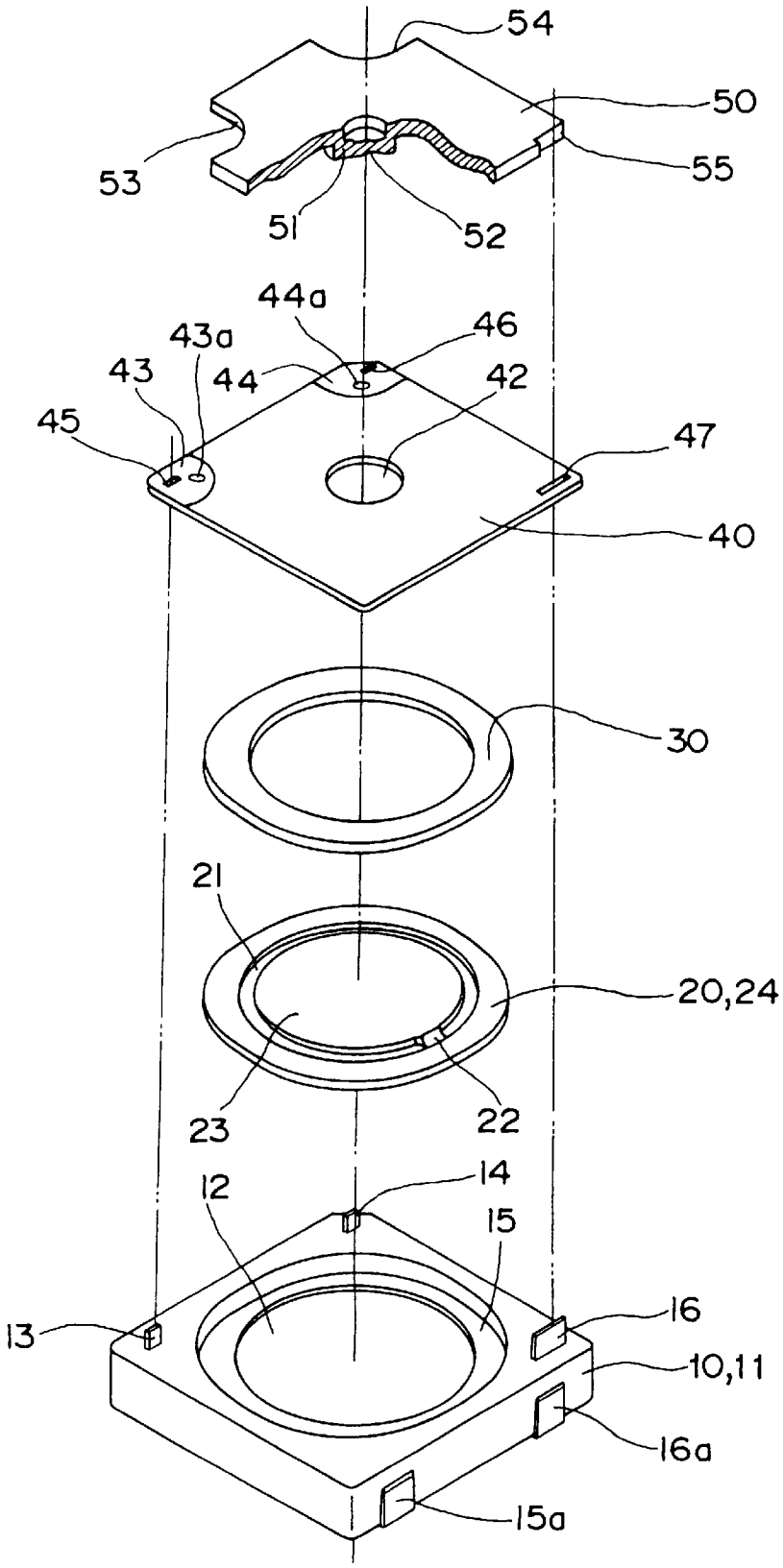
FIG. 1 is an exploded perspective view of a relay according to a first embodiment of the present invention.
Figure 2:
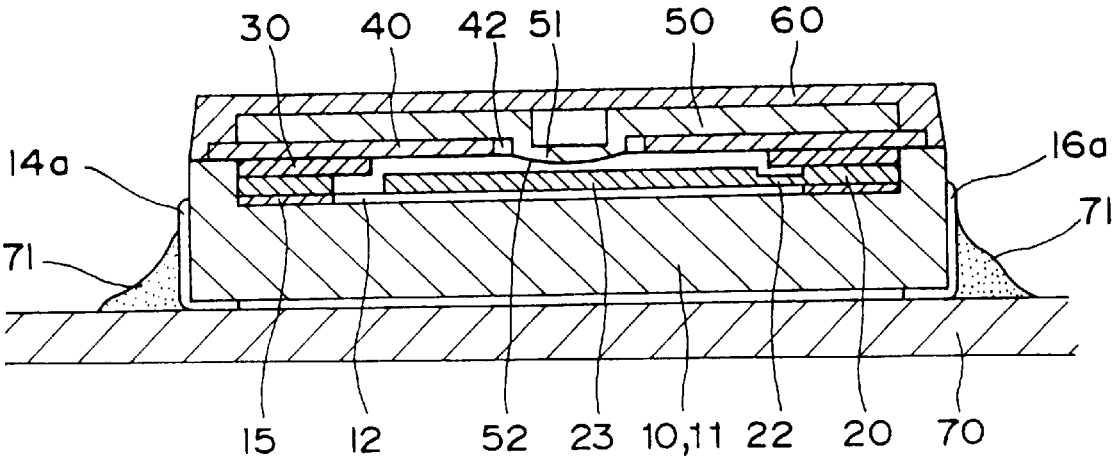
FIG. 2 is a sectional view showing a mounted state of the relay of the first embodiment.

First, as shown in FIG. 1 and FIG. 2, a relay according to a first embodiment of the present invention is roughly constructed of a base 10, a movable contact plate 20, a supplementary yoke 30, a coil plate 40, a fixed contact plate 50 and an insulating cover 60.

The base 10 is constructed by insert-forming a pair of coil terminals 13 and 14, a movable contact terminal 15 and a fixed contact terminal 16 in a base body 11 having an approximately square box shape in plan and bending upright their respective terminals portions 13*a*, 14*a*, 15*a* and 16*a* (the terminals portions 13*a* and 14*a* are not shown in FIG. 1) to the outer side surface of the base body 11, where, in particular, a ring-shaped movable contact terminal 15 is exposed from a bottom edge portion of a recessed portion 12 provided on the upper surface of the base body 11.

The movable contact plate 20 is a thin plate made of a conductive magnetic material having a planar shape capable of being fitted in the recessed portion 12 of the base body 11. A slit 21 having a C-figured shape in plan is formed by press-processing, etching or the like, thereby forming a hinge portion 22 and dividing a movable contact piece 23 and a yoke 24. Further, the hinge portion 22 is reduced in thickness to allow the movable contact piece 23 to pivot with a small external force, and this provides an advantage that a relay having a high sensitivity can be obtained.

As occasion demands, it is acceptable to provide a portion which belongs to the upper surface of the movable contact piece 23 and comes in contact with at least a fixed contact described later with a contact material of gold, platinum or the like having an excellent conductivity by plating, vapor deposition, sputtering, pressure welding, welding, caulking, brazing or the like.

As a conductive magnetic material, there can be enumerated, for example, iron-based amorphous metals, permalloy and the like.

Further, the movable contact plate 20 is not always required to be made singly of a conductive magnetic material, and the whole shape is formed of a spring material of beryllium copper, amorphous metals or the like. Further, the plate may be a one whose portion excluding the hinge portion 22 is integrated with a soft magnetic material of permalloy, electromagnetic pure iron or the like by ultrasonic cladding via soldering, gold plating or the like. This arrangement provides an advantage that a great attraction force can be obtained while securing a desired spring force.

Then, the movable contact plate 20 is fitted in the recessed portion 12 of the base 10, and by electrically connecting the yoke 24 to the movable contact terminal 15 by the method of pressure welding, welding, brazing or the like, the movable contact piece 23 is pivotally supported in the vertical direction with the hinge portion 22 made to serve as a fulcrum as shown in FIG. 2.

Figure 5A:
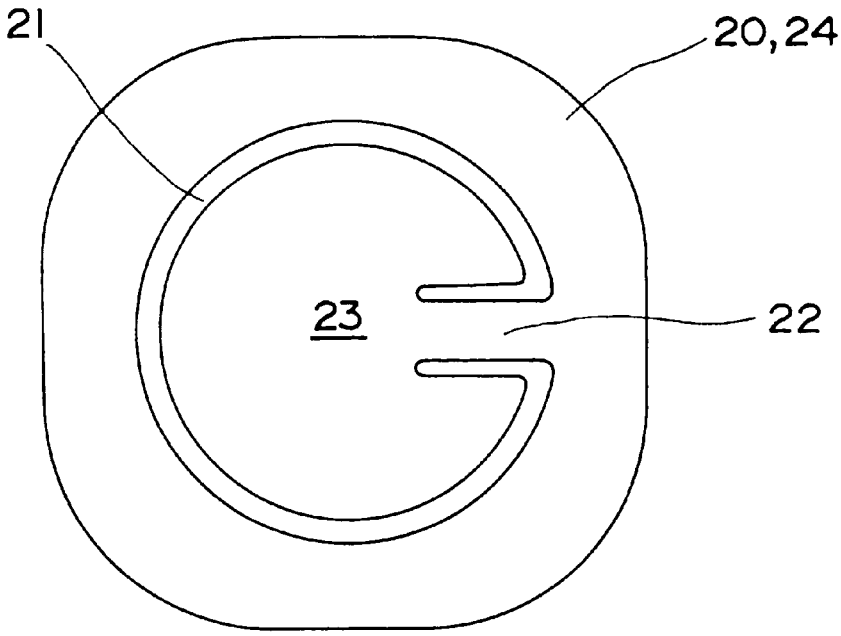
FIGS. 5A and 5B are plan views showing other application examples of the movable contact plate.
Figure 5B:
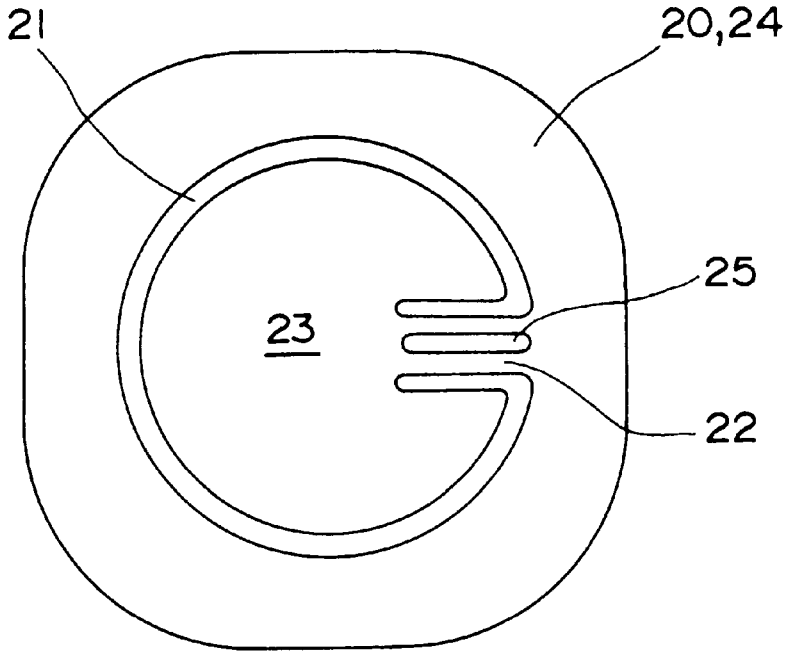

It is to be noted that the shape of the movable contact plate 20 is not limited to the aforementioned shape, and for example, it is acceptable to elongate the hinge portion 22 as shown in FIG. 5A or provide an elongated through hole 25 at the elongated hinge portion 22 as shown in FIG. 5B. By forming such a hinge portion 22, the movable contact piece 23 can be made to pivot in the direction of plate thickness by a smaller external force, and this provides an advantage that a relay having a higher sensitivity can be obtained.

When the movable contact piece 23 cannot be made to pivot at a desired speed by a resistance of the internal gas in the sealed space, for example, it is acceptable to provide the movable contact piece 23 with one or a plurality of through holes (not shown) for air bleeding use.

Figure 3A:
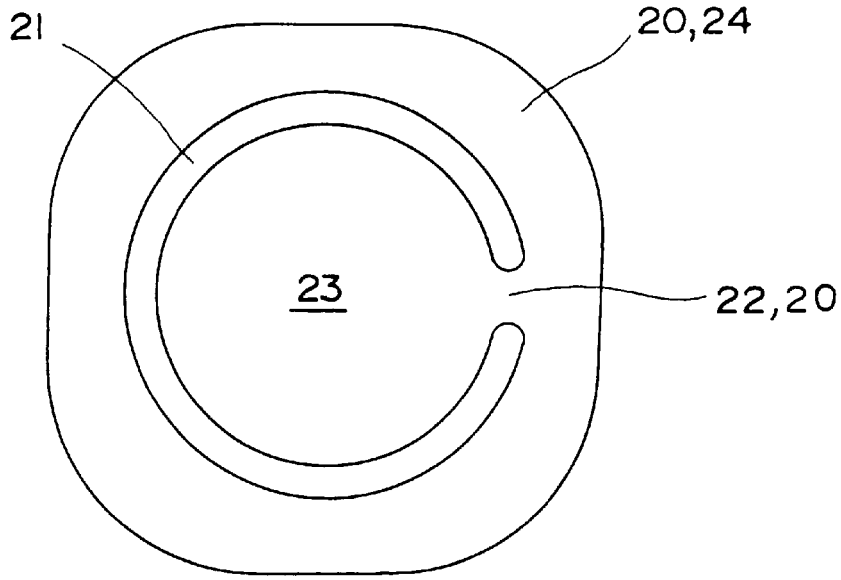
FIG. 3A is a plan view of a movable contact plate.
Figure 3B:
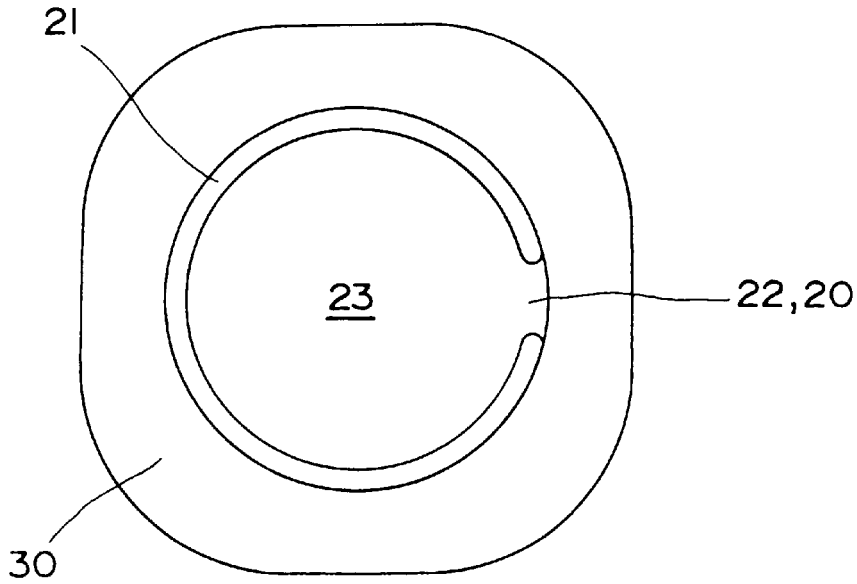
FIG. 3B is a plan view showing a state in which a supplementary yoke is fixed to the movable contact plate.
Figure 3C:
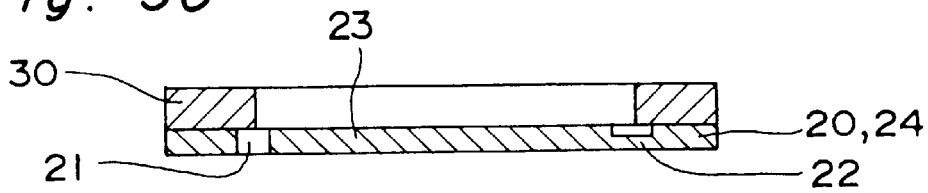
FIG. 3C is a sectional view of the state in which the supplementary yoke is fixed to the movable contact plate.

The supplementary yoke 30 is a thin plate formed of a ring-shaped magnetic material having an outer periphery shape capable of being fitted in the recessed portion 12 of the base body 11 for the purpose of securing a pivoting space of the movable contact piece 23 and reducing a magnetic resistance, and as shown in FIG. 3C, its inner diameter is smaller than the inner diameter of the yoke 24 and is larger than the diameter of the movable contact piece 23. The above dimensional specifications are provided for making easy manufacturing without increasing the magnetic resistance.

That is, for reducing the magnetic resistance, it is intrinsically preferable to process the C-figured slit 21 of the movable contact plate 20 as slim as possible, thereby putting the movable contact piece 23 and the yoke 24 close to each other. However, it is not easy to process a slim slit, and this increases the processing cost. On the other hand, the supplementary yoke 30 to be integrated by bonding with the upper surface of the yoke 24 can be easily manufactured with an accuracy equivalent to that of the diameter of the movable contact piece 23. For this reason, the supplementary yoke 30 having the aforementioned inner diameter is formed in an attempt at reducing the gap between the movable contact piece 23 and the supplementary yoke 30.

Then, the supplementary yoke 30 is fitted in the recessed portion 12 of the base 10 and stacked on the movable contact plate 20, by which its upper surface and the upper surface of the base body 11 are approximately in flush with each other (FIG. 2). On the other hand, an inner peripheral edge portion of the supplementary yoke 30 and an outer peripheral edge portion of the movable contact piece 23 come close to each other (FIG. 3C) and the gap between them is made smaller than the width dimension of the slit 21, thereby providing an advantage that the magnetic resistance is reduced and a high sensitivity is achieved.

It is to be noted that the supplementary yoke 30 is not always required to have a ring-like shape, and for example, it may have a discontinuous C-figured shape in plan.

Figure 4A:
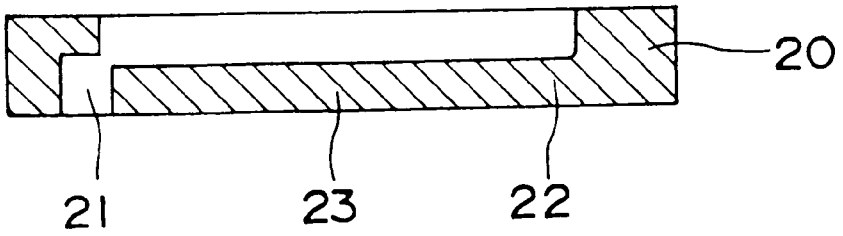
FIGS. 4A and 4B are sectional views showing other application examples of the movable contact plate.
Figure 4B:
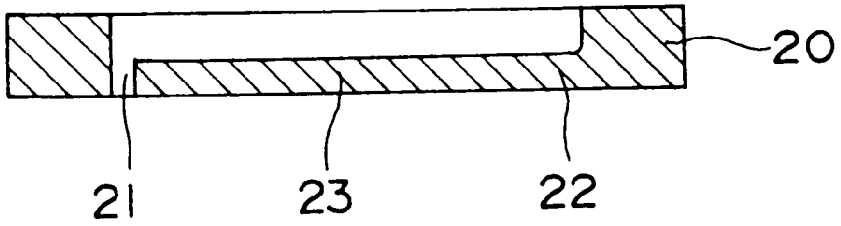

In the aforementioned embodiment, the movable contact plate 20 and the supplementary yoke 30 are provided by separate members. However, the present invention is not always limited to this, and for example, there may be a movable contact plate 20 having an integrally formed cross-section shape as shown in FIG. 4A or a movable contact plate 20 having another integrally formed cross-section shape as shown in FIG. 4B. By adopting an integral form as above, there is an advantage that reduced numbers of components and assembly processes result and the assembling accuracy and productivity improve.

Furthermore, the supplementary yoke 30 is not always necessary. When the supplementary yoke 30 is not provided, it is proper to bend the movable contact piece 23 toward the lower side.

Figure 6A:
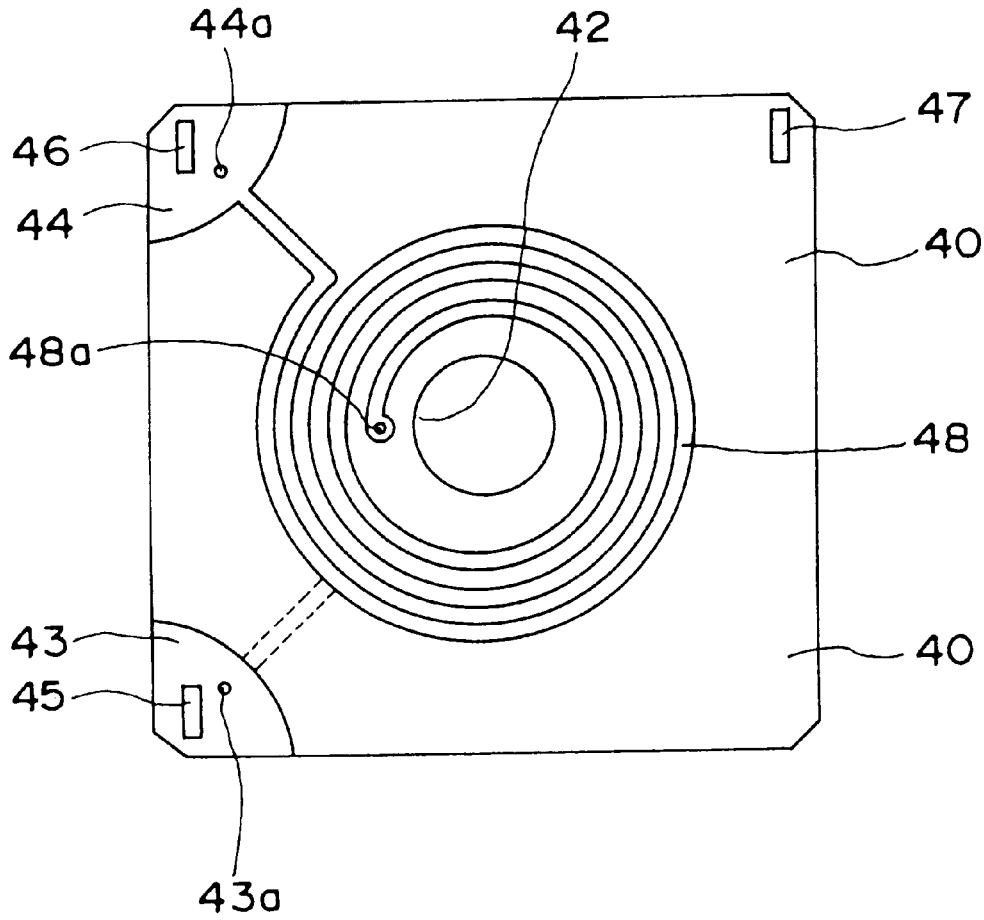
FIGS. 6A and 6B are plan and sectional views showing a coil plate.
Figure 6B:
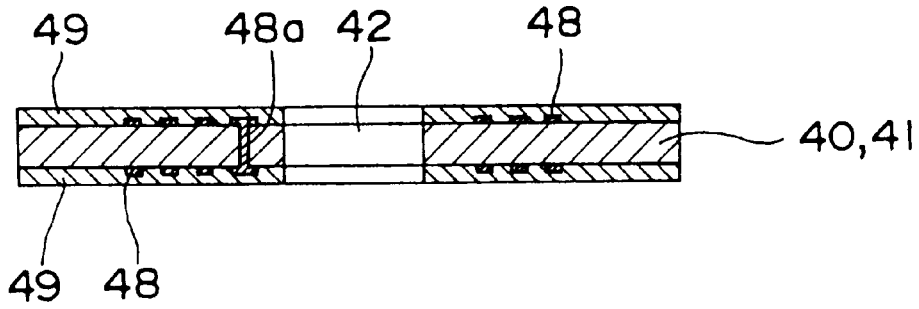

As shown in FIGS. 6A and 6B, the coil plate 40 is constructed of an insulative substrate 41 having a planar shape capable of almost covering the upper surface of the base body 11 and is provided with a through hole 42 at the center. On the other hand, connecting conductors 43 and 44 are formed on the upper and lower surfaces of adjacent corner portions, and terminals holes 45, 46 and 47 are provided in positions corresponding to the coil terminals 13 and 14 and the fixed contact terminal 16 of the base 10. The connecting conductors 43 and 44 are provided with through holes 43*a* and 44*a* for electrically connecting the upper and lower surfaces. Further, a flat coil 48 extending from the connecting conductor 44 is formed spirally around the through hole 42, and its tip portion is electrically connected via a through hole 48*a* to a spiral flat coil 48 formed on the rear surface of the insulative substrate 41. Its tip portion extends to the connecting conductor 43 (not shown) on the rear surface and is electrically connected to the connecting conductor 43 on the front surface via a through hole 43*a*. Further, the front and rear surfaces of the coil plate 40 are covered with an insulating film 49. It is to be noted that the forming method of the flat coil 48 is not specifically limited, and any of the existing methods of, for example, printing, transfer, vapor deposition, sputtering, thermal spraying, etching and so on can be arbitrarily selected.

Then, the coil plate 40 is positioned with the coil terminals 13 and 14 and the fixed contact terminal 16 of the base 10 fitted in its terminals holes 45, 46 and 47, and thereafter the coil terminals 13 and 14 are electrically connected to the connecting conductors 43 and 44, respectively, by pressure welding, welding, brazing or the like.

Although the flat coil 48 is formed on the front and rear surfaces of the insulative substrate 41 of the coil plate 40 according to the above description, the present invention is not always limited to this, and it is acceptable to form the coil on one surface or bond each other insulative substrates each having the flat coil 48 on one surface so that the flat coils 48 are located outside.

Furthermore, if there is an increased number of layers of the flat coil 48, then an increased thickness dimension corresponding to the multiplication of the thickness dimensions of the flat coils 48 and the insulating film 49 by the number of the layers results. Consequently, the thickness dimension of the whole coil plate 40 increases to increase the gap between the supplementary yoke 30 and the fixed contact plate 50, resulting in increasing the magnetic resistance. Therefore, by forming only a flat coil to be electrically connected to the connecting conductors 43 and 44 in the region which belongs to the front and rear surfaces of the coil plate 40 and is directly held between a fixed contact plate 50 and a supplementary yoke 30 as described later and spirally forming the flat coil 48 inwardly from the region in order not to increase the magnetic resistance, it is merely required to form a single-layer insulating film 49 in the portion directly held between the fixed contact plate 50 and the supplementary yoke 30. This arrangement provides an advantage that the gap between the supplementary yoke 30 and the fixed contact plate 50 does not increase and the increase in magnetic resistance can be suppressed to the minimum.

The fixed contact plate 50 is made of a conductive magnetic material having a planar shape capable of almost covering the coil plate 40. As the conductive magnetic material, there can be enumerated, for example, iron-based amorphous metals, permalloy and the like. The fixed contact plate 50 is constructed so that a tip portion of an iron core 51 which is a projecting section formed by downwardly projecting its center portion is made to serve as a fixed contact 52, and cut portions 53 and 54 for securing an insulating property and a cut portion 55 for securing the electrical connection to the fixed contact terminal 16 of the base 10 are provided at adjacent corner portions.

As occasion demands, it is acceptable to provide a portion which belongs to the fixed contact 52 and comes in contact with at least the movable contact piece 23 with a contact material of gold, platinum or the like having an excellent conductivity by plating, vapor deposition, sputtering, pressure welding, welding, caulking, brazing or the like.

The fixed contact 52 is not always required to be integrated with the fixed contact plate 50, and it is acceptable to fix the fixed contact 52 comprised of a separate body to the fixed contact plate 50 by press-fitting, caulking or brazing. For example, it is acceptable to provide the fixed contact plate 50 with a through hole having a diameter identical to the diameter of the fixed contact 52 separately provided, press-fit the fixed contact 52 to a specified position and fix the same while measuring a contact gap in the final stage of assembling.

Then, by tightly fitting the iron core 51 of the fixed contact plate 50 into the through hole 42 of the coil plate 40, tightly fixing the same and electrically connecting the fixed contact terminal 16 of the base 10 to the cut portion 55 of the fixed contact plate 50 by pressure welding, welding, brazing, caulking or the like, the fixed contact 52 projects slightly downwardly from the coil plate 40 and faces so as to be able to come in and out of contact with the movable contact piece 23 while keeping a specified contact gap (FIG. 2).

By forming a resin film of polyether sulfone or the like on the lower surface of the fixed contact plate 50 excluding the projecting section 51, forming the coil plate 40 of the base 10 of a similar resin or forming a similar resin film on the bonding surfaces of them and integrating them by bonding according to the method of thermal pressure welding, ultrasonic welding, solvent adhesion or the like, a sealed structure can be easily achieved.

When the base body 11 and the coil plate 40 are formed of ceramic or glass, a firmer sealed structure can be achieved by anodic bonding. With such a sealed structure, the external entry of corrosive gas, foreign materials and the like can be prevented. It is also acceptable to improve the insulating property by forming a high vacuum or filling and sealing a gas or liquid having a high insulating property (sulfur hexafluoride gas, for example) in the sealed space.

The insulating cover 60 may be a resin formed product having a planar shape covering the coil plate 40 and the fixed contact plate 50 fixed to the base 10 or formed of epoxy resin or the like by injection molding or low pressure molding.

Then, the relay having the aforementioned construction is surface-mounted on a printed board 70 via solder 71 as shown in FIG. 2.

According to the aforementioned embodiment, there has been a description for the case where the fixed contact plate 50 and the supplementary yoke 30 are constructed of components separate from the coil plate 40. However, the present invention is not always limited to this, and it is acceptable to integrally form the supplementary yoke 30 and so on by plating or vapor deposition or the like on the lower surface of the coil plate 40 or, conversely, integrally form at least one layer of the flat coil 48 by plating or vapor deposition on the lower surface of the fixed contact plate 50.

The operation of the relay having the above construction will be described next.

First, when no voltage is applied to the coil terminals 13 and 14 and the flat coil 48 of the coil plate 40 is not excited, then the movable contact piece 23 and the fixed contact 52 face each other with interposition of a specified contact gap, and the movable contact terminal 15 and the fixed contact terminal 16 are in an open circuit state.

When a voltage is applied to the coil terminals 13 and 14 to excite the flat coil 48, then a magnetic flux is generated along the axis of the iron core 51 and flows through a magnetic path formed in order of the movable contact piece 23, yoke 24, supplementary yoke 30 and fixed contact plate 50. Consequently, the movable contact piece 23 is attracted to the iron core 51 of the fixed contact plate 50 against the spring force of the hinge portion 22 of the movable contact plate 20 and brought in contact with the fixed contact 52, thereby closing the electric circuit.

Subsequently, when the excitation of the flat coil 48 is released, then the magnetic flux disappears and the movable contact piece 23 returns to the original state by the spring force of the hinge portion 22, so that the movable contact piece 23 separates from the fixed contact 52, thereby opening the electric circuit.

Figure 7:
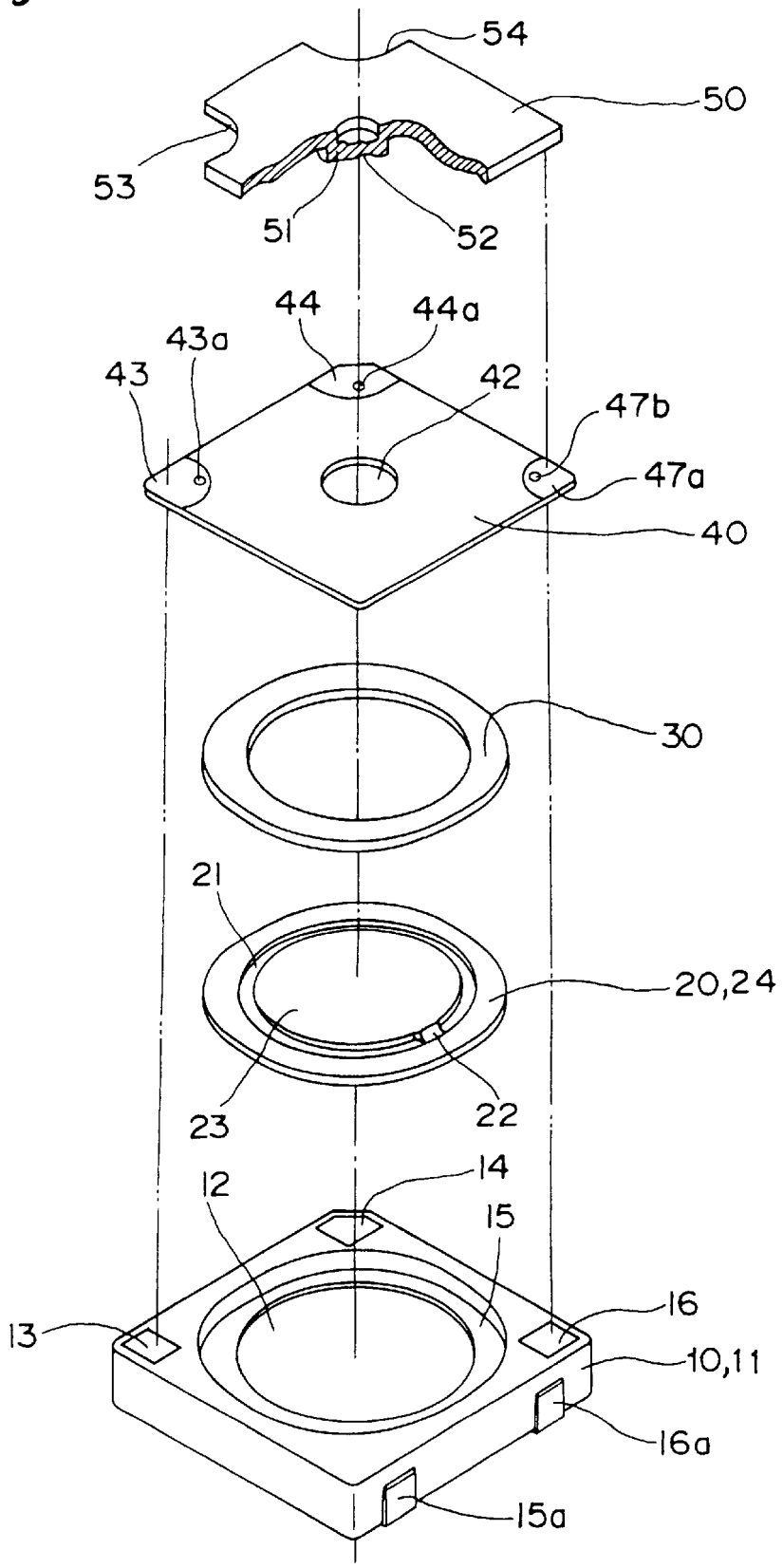
FIG. 7 is an exploded perspective view of a relay according to a second embodiment of the present invention.

According to a second embodiment of the present invention, as shown in FIG. 7, the upper end portions of the coil terminals 13 and 14 and the fixed contact terminal 16 are buried so as to be in flush with the upper surface edge portion of the base body 11 in contrast to the aforementioned first embodiment in which the upper end portions of the coil terminals 13 and 14 and the fixed contact terminal 16 are made to project from the upper surface edge portion of the base body 11. Then, for achieving electrical connection, connecting conductors 43 and 44 and an intermediate conductor 47*a* are provided on the front and rear surfaces of adjacent corner portions of the coil plate 40, and through holes 43*a*, 44*a* and 47*a* are provided for the achievement of a continuity in the vertical direction. Further, the fixed contact plate 50 is provided with only cut portions 53 and 54 for securing an insulating property.

Accordingly, the coil plate 40 is mounted on the base 10 assembled with the movable contact plate 20 and the supplementary yoke 30 similar to the aforementioned case, and the connecting conductors 43 and 44 and the intermediate conductor 47*a* are integrated with the upper end portions of the buried coil terminals 13 and 14 and the fixed contact terminal 16, respectively, by pressure welding, caulking or brazing. Further, similar to the first embodiment, the fixed contact plate 50 tightly fitted and fixed to the coil plate 40 is electrically connected to the fixed contact terminal 16 via the intermediate conductor 47*a* by pressure welding, caulking or brazing. The other part is approximately the same as that of the first embodiment, and therefore, no description is provided therefor.

According to the present embodiment, the coil terminals 13 and 14 and so on are not required to be projected even in the case where the base body 11 is constructed of a ceramic package, and this provides an advantage that the manufacturing cost can be reduced.

Figure 8:
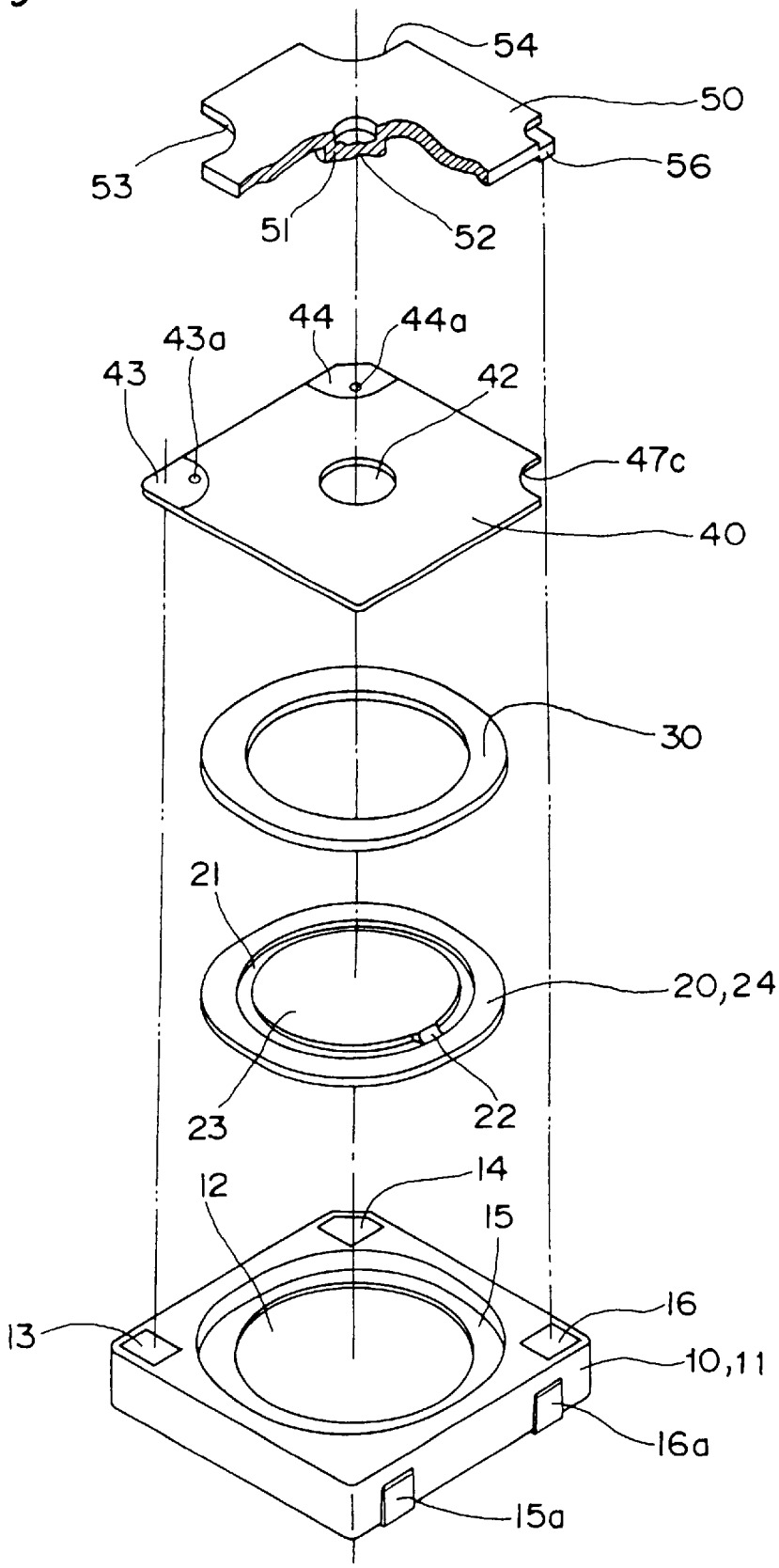
FIG. 8 is an exploded perspective view of a relay according to a third embodiment of the present invention.

According to a third embodiment of the present invention, as shown in FIG. 8, a corner portion of the fixed contact plate 50 is subjected to an extruding process for the provision of a connecting stepped portion 56 projecting downward and a corner portion of the coil plate 40 located between this connecting stepped portion 56 and the fixed contact terminal 16 is cut away to have a cut portion 47*c*, so that the connecting stepped portion 56 of the fixed contact plate 50 is directly integrated with the upper end portion of the fixed contact terminal 16 of the base 10 for the achievement of electrical connection in contrast to the aforementioned second embodiment in which the fixed contact terminal 16 is electrically connected to the fixed contact plate 50 via the intermediate conductor 47*a* provided at the coil plate 40. The other part is approximately the same as that of the first embodiment, and therefore, no description is provided therefor.

According to the present embodiment, there is an advantage that the intermediate conductor can be eliminated, processing is made easy and the assembling accuracy and the contact reliability improve.

The movable contact piece 23 comes in and out of contact with the fixed contact 52 projecting from the through hole 42 of the coil plate 40 in the aforementioned embodiment. However, the present invention is not always limited to this, and for example, it is acceptable to provide the fixed contact 52 on a flat surface of the fixed contact plate 50 and provide the movable contact piece 23 with a projected portion by an extruding process, a raising process or the like to make the tip portion serve as the fixed contact 52.

Furthermore, it is acceptable to provide the movable contact piece 23 with a movable contact made of another material and thereby make the movable contact of the movable contact piece 23 come in and out of contact with the fixed contact 52 that is not protruding from the through hole 42.

Furthermore, it is acceptable to provide the fixed contact plate 50 and the movable contact piece 23 with respective projected portions and use their tip portions as the fixed contact and the movable contact.

As shown in the accompanying drawings of FIG. 9 through FIG. 15B, a fourth embodiment of the present invention is an application of the invention to a matrix relay, and it is approximately constructed of a base 110, a movable contact unit 120 comprised of four movable contact plates 121, a supplementary yoke unit 130 comprised of four supplementary yoke plates 131, a coil plate 140, a fixed contact unit 150 comprised of four fixed contact plates 151 and an insulating cover 160.

The base 110 is formed by inserting four coil terminals $l_1$, $l_2$, $l_3$ and $l_4$, four coil terminals $k_1$, $k_2$, $k_3$ and $k_4$, four movable contact terminals $K_1$, $K_2$, $K_3$ and $K_4$ and four fixed contact terminals $L_1$, $L_2$, $L_3$ and $L_4$ into the respective sides of the base body 111 having an approximately square shape in plan.

The base body 111 is constructed so that connecting end portions 113 and 114 of the coil terminals l and k are exposed at the peripheral edge portions of a bottom surface 112 provided a step lower than its opening edge portion and a connecting end portion 115 of the fixed contact terminal L is projecting. Further, at the center of the bottom surface 112 are arranged parallel four recessed portions 116 (described later) capable of allowing the movable contact unit 120 to be fitted therein. At the bottom surface corner portions of the recessed portions 116 are exposed connecting terminal portions 117 of the fixed contact terminals K.

The movable contact plates 121 of the movable contact unit 120 are thin plates each made of a conductive magnetic material having a planar shape capable of being fitted in the recessed portion 116 of the base body 111, and movable contact pieces 123 are cut out by forming at a specified pitch slits 122 each having an approximately C-figured shape in plan.

As occasion demands, it is acceptable to provide a portion which belongs to the upper surface of each movable contact piece 123 and comes in contact with at least a fixed contact 153 described later with a contact material of gold, platinum or the like having an excellent conductivity by plating, vapor deposition, sputtering, pressure welding, welding, caulking, brazing or the like.

Then, the movable contact plates 121 are fitted in the respective recessed portions 116 of the base 110, and by electrically connecting the one end portion of each of the plates to the connecting end portions 117 of the movable contact terminals K by the method of pressure welding, welding, brazing or the like, the movable contact piece 123 is pivotally supported in the direction of plate thickness.

The supplementary yoke unit 130 is provided for securing a pivoting space of the movable contact piece 123 and reducing the magnetic resistance. Accordingly, the supplementary yoke plates 131 constituting the supplementary yoke unit 130 are thin plates each made of a magnetic material having s planar shape capable of being fitted in the recessed portion 116 of the base body 111 and provided with a through hole 132 having a diameter slightly greater than the outer diameter of the movable contact piece 123 in a position corresponding to the piece. The above diameter specification is provided for reducing the magnetic resistance and making easy manufacturing.

Namely, it is intrinsically proper to form a C-figured slit 122 which is reduced in width as far as possible at the movable contact plates 121 to reduce the magnetic resistance and increase the magnetic efficiency. However, it is not easy to form a slim slit, and this causes an increase in processing cost on the other hand, the supplementary yoke plates 131 to be integrated by bonding with the upper surface of the movable contact plates 121 can be easily provided with the through hole 132 with an accuracy equivalent to that of the diameter of the movable contact piece 123. For this reason, the supplementary yoke plates 131 are each formed with the through hole 132 so as to minimize the gap between the movable contact piece 123 and the supplementary yoke plate 131.

Figure 9:
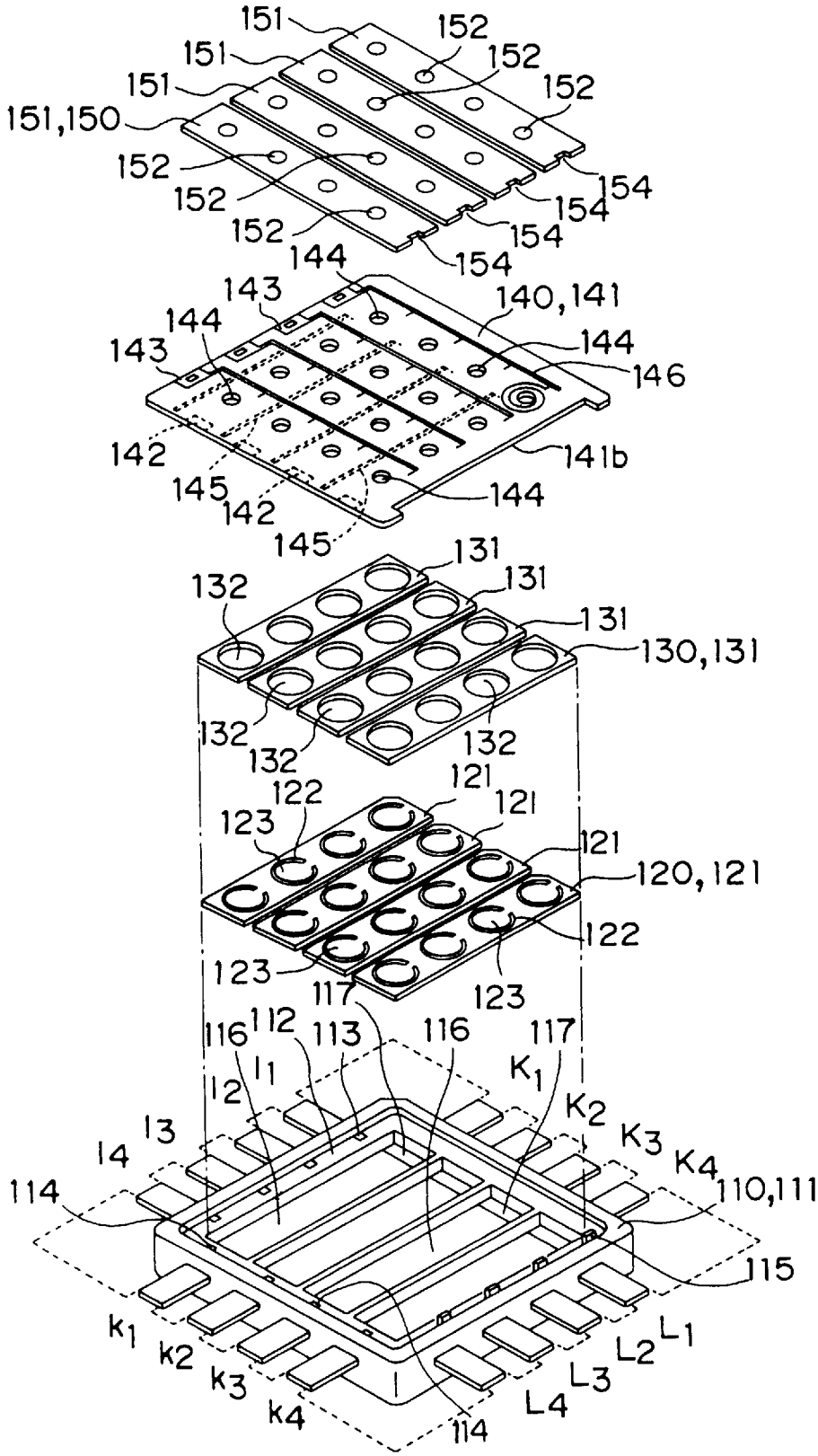
FIG. 9 is an exploded perspective view of a matrix relay according to a fourth embodiment of the present invention.

Then, the supplementary yoke plates 131 are stacked on the movable contact plates 121 and fitted in the recessed portions 116 of the base 110, so that their upper surfaces and the bottom surface 112 of the base body 111 are approximately in flush with each other (FIG. 9 and FIG. 11). Further, an inner peripheral edge portion of the through hole 132 of each supplementary yoke plate 131 and an outer peripheral edge portion of the movable contact piece 123 come close to each other, so that the gap between both the members becomes smaller than the width dimension of the slit 122. Therefore, the magnetic resistance reduces, and this provides an advantage that a relay having a high sensitivity can be obtained.

Figure 10A:
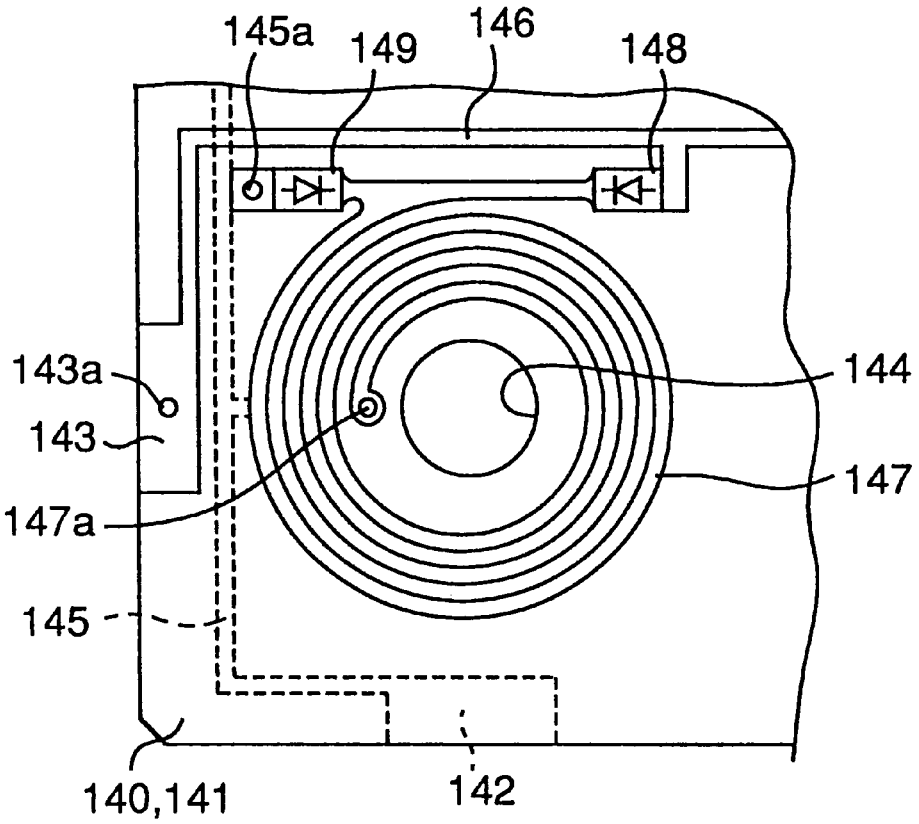
FIG. 10A is an enlarged view of part of the coil plate shown in FIG. 9.
Figure 10B:
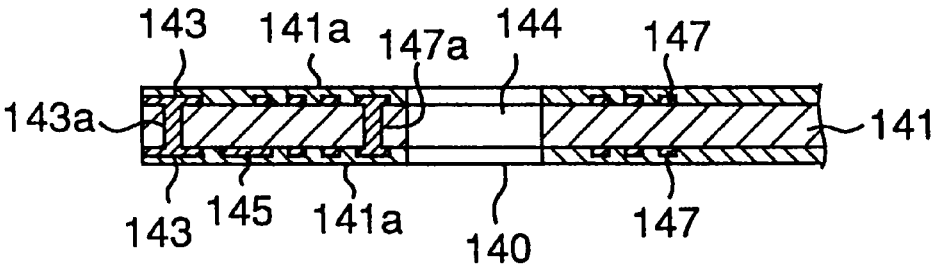
FIG. 10B is a sectional view of part of it.

The coil plate 140 is constructed of an insulative board 141 having a planar shape capable of covering the bottom surface 112 of the base body 111 and is constructed so that k-line coil terminal connecting portions 142 and l-line coil terminal connecting portions 143 are provided at a specified pitch on lower surface edge portions of adjacent sides and through holes 144 are provided at a specified pitch. As shown in FIG. 10A and FIG. 10B, common connecting lines 145 are formed so as to extend parallel at a specified pitch from the connecting portions 142 on the rear surface of the insulative board 141. On the other hand, common connecting lines 146 are extended parallel at a specified pitch from the connecting portions 143 via through holes 143*a* on the front surface of the insulative board 141, so that the common connecting lines 145 and the common connecting lines 146 cross each other in a matrix form in an insulated state.

The common connecting lines 145 extending from the connecting portions 142 are each connected to a spiral flat coil 147 formed around the through hole 144 on the rear surface of the insulative board 141. The flat coil 147 has its tip portion led to the front surface of the insulative board 141 via the through hole 147*a* and is formed in a spiral form around the through hole 144. The flat coil 147 has its tip portions connected in series with the common connecting line 146 via a reverse current preventing diode 148 and connected to a flywheel diode 149. This flywheel diode 149 is connected via a through hole 145*a* to the common connecting line 145 formed on the rear surface of the insulative board 141. Therefore, the flat coil 147 connected parallel to the flywheel diode 149 is connected in series with the reverse current preventing diode 148.

The flywheel diode 149 is provided for delaying the attenuation of an excitation current generated in the flat coil 147. However, the present invention is not limited to this, and it is acceptable to use, for example, a capacitor or concurrently use a resistor.

The insulative board 141 has its front and rear surfaces covered with an insulating film 141*a*.

Then, the coil plate 140 is fitted to the bottom surface 112 of the base 110, and connecting portions 143 and 142 of the coil plate 140 are electrically connected to connecting end portions 113 of the coil terminals $l_1$, $l_2$, $l_3$ and $l_4$ and connecting end portions 114 of the coil terminals $k_1$, $k_2$, $k_3$ and $k_4$, respectively. In this case, the upright connecting end portions 115 of the fixed contact terminals $L_1$, $L_2$, $L_3$ and $L_4$ are exposed from a cut portion 141*b* of the coil plate 140.

The fixed contact plates 151 of the fixed contact unit 150 are each made of a strip-shaped conductive magnetic plate and subjected to an extruding process to use the resulting projecting portion as an iron core 152 and use its tip portion as a fixed contact 153.

Figure 11A:
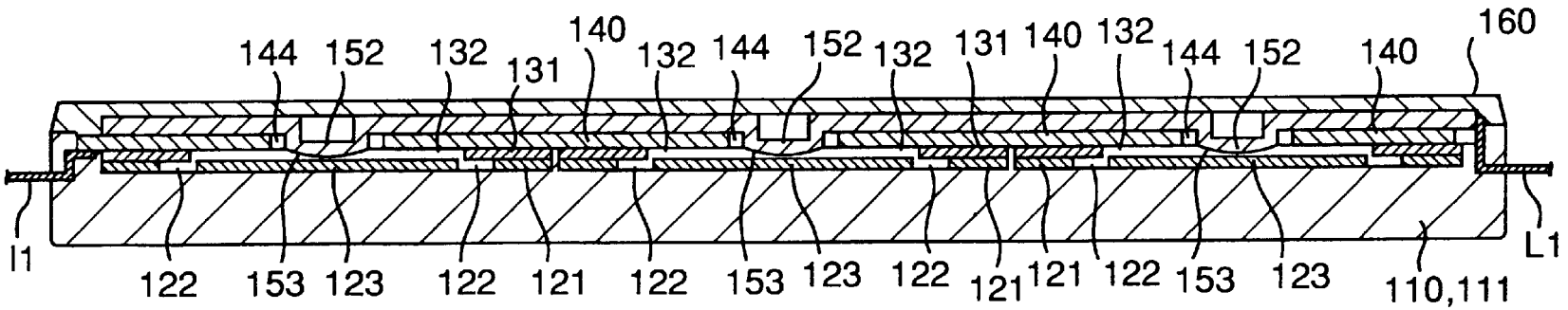
FIG. 11A is a transverse sectional view of the matrix relay shown in FIG. 9.
Figure 11B:
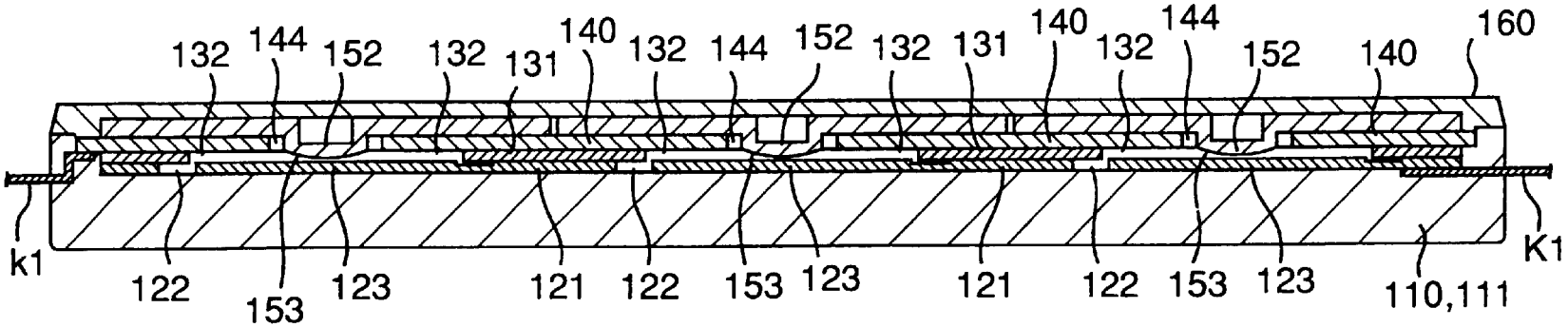
FIG. 11B is a longitudinal sectional view of it.
Figure 12A:
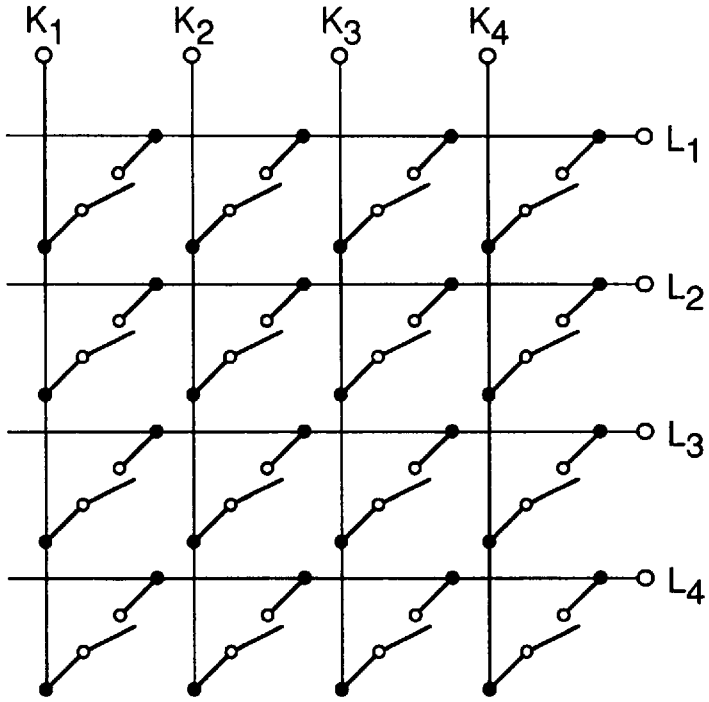
FIG. 12A is a circuit diagram of a contact section of the matrix relay shown in FIG. 9.
Figure 12B:
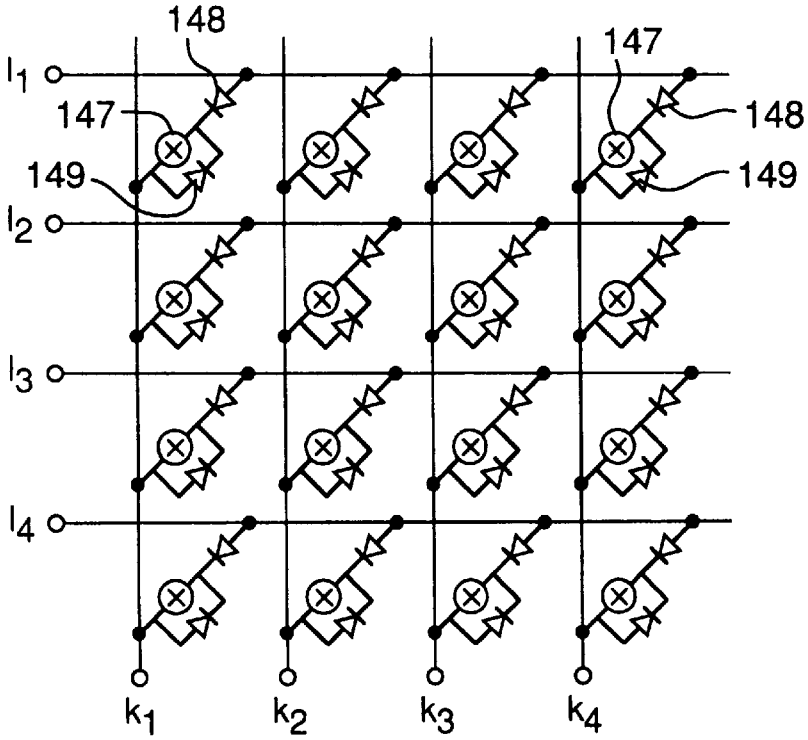
FIG. 12B is a circuit diagram of its coil section.

The fixed contact plates 151 have a cut portion 154 provided at one end portion engaged with the terminal portion 115 of the fixed contact terminal L and are electrically connected by pressure welding, welding, brazing, caulking or the like while being arranged parallel, so that a lower end portion of the iron core 152 slightly projects from the lower surface of the coil plate 140, and the fixed contact 153 and the movable contact piece 123 face each other so as to be able to come in and out of contact with each other while keeping a specified contact gap (FIG. 11A and FIG. 11B).

The insulating cover 160 is a resin formed product having a planar shape capable of covering the coil plate 140 and the fixed contact plates 151 fixed to the base 110. However, the present invention is not limited to this, and it may be integrally formed of, for example, epoxy resin or the like by low-pressure forming.

The fixed contact plates 151 and the supplementary yoke plates 131 are constructed of components separate from the coil plate 140 in the aforementioned embodiment according to the description. However, the present invention is not limited to this, and it is acceptable to integrally form a supplementary yoke or the like on the lower surface of the coil plate 140 by plating, vapor deposition or the like or, conversely, form a flat coil of at least one layer by plating or vapor deposition via an insulating layer on the lower surface of each fixed contact plate 151.

A driving method of the present embodiment will be described next. It is to be noted that a driving method of a matrix relay constructed of a total of nine relay units comprised of three longitudinal units by three lateral units as shown in FIG. 13A through FIG. 15B will be described for the sake of convenience in explanation.

Figure 13A:
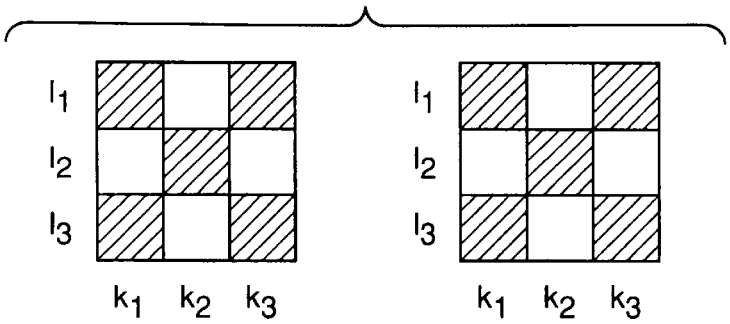
FIG. 13A is a pattern view showing an operating region for explaining a control method.
Figure 13B:
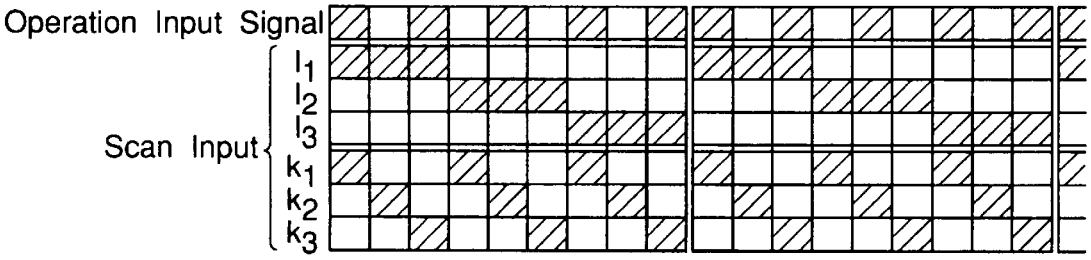
FIG. 13B is a timing chart of it.

Based on the timing chart shown in FIG. 13B, a scan input signal is inputted to the matrix relay via an external scan input means (not shown), so that nine circuits are independently successively selected in one cycle.

Figure 13C:
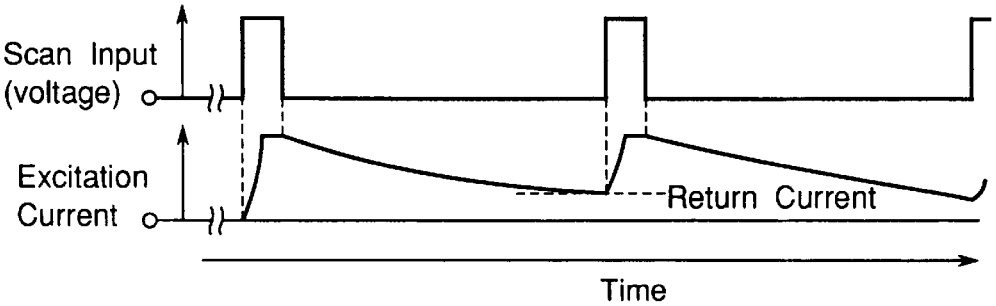
FIG. 13C is a signal waveform chart of it.

When an operation input signal is inputted according to an operation input signal pattern of the timing chart shown in FIG. 13B, a pulse signal (voltage) as shown in FIG. 13C is applied to the corresponding coil terminals l and k or, for example, the coil terminals $l_1$ and $k_1$ in the hatched region in FIG. 13A. Accordingly, excitation currents flow through the flat coils 147 connected to them, and magnetic forces generated by this operation attract the movable contact pieces 123. Consequently, the movable contact pieces 123 pivot in the direction of plate thickness to come in pressure contact with the fixed contacts 153, thereby making a continuity between the fixed contact terminal $L_1$ and the movable contact terminal $K_1$.

Since the operation input signal is a pulse signal, the excitation current generated by this is intrinsically attenuated. However, since the flywheel diode 149 is connected parallel to the flat coil 147, the attenuation of the excitation current is delayed, thereby not making the excitation current lower than a return current in one cycle. As a result, when the operation input signal is inputted one time in a cycle, the movable contact piece 123 is attracted to the fixed contact 153, closing the circuit.

Therefore, if the operation input signal continues to be inputted in one cycle at specified intervals shown in FIG. 13B, then the desired relay units indicated by the hatching in FIG. 13A maintain the ON-state.

When a circuit comprised of the coil terminals $l_1$ and $k_3$ is selected by the scan input signal in a similar manner and an operation input signal (voltage) is applied, then the flat coil 147 of the relay corresponding to this is excited and the movable contact piece 123 is attracted to the fixed contact 153 so as to come in pressure contact with it, consequently making a continuity between the fixed contact terminal $L_1$ and the movable contact terminal $K_3$.

Therefore, by merely adjusting the input pattern of the operation input signal, the desired circuit can be opened and closed by exciting the flat coil 147 of the corresponding circuit and making the movable contact piece 123 come in and out of contact with the fixed contact 153.

When the pulse signal serving as the operation input signal stops being inputted, the application of a voltage corresponding to each flat coil 147 stops and the magnetic force of the flat coil 147 disappears, as a consequence of which the movable contact piece 123 is put back into the original state by the spring force of itself.

Figure 14A:
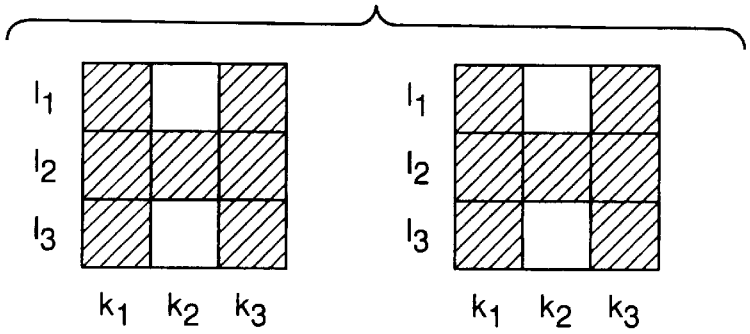
FIG. 14A is a pattern view showing an operating region for explaining another control method.
Figure 14B:
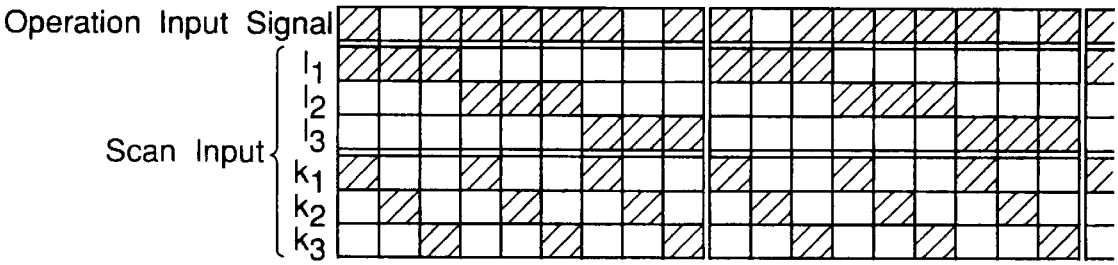
FIG. 14B is a timing chart of it.

When driving a relay in another position, or when operating, for example, the relay units in the hatched regions shown in FIG. 14A, upon applying a voltage to the flat coil according to an operation input signal pattern as shown in the timing chart of FIG. 14B, an excitation current is formed through the flat coil 147 to which the voltage is applied, and the movable contact piece 123 is put in pressure contact with the fixed contact 153 while being attracted by the iron core 152, consequently closing the circuit.

Figure 15A:
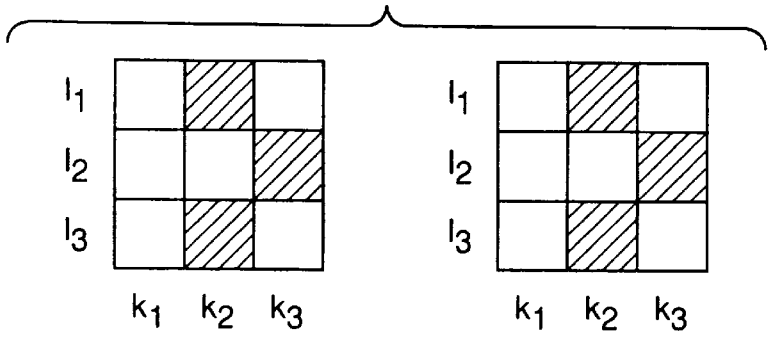
FIG. 15A is a pattern view showing an operating region for explaining another control method.
Figure 15B:
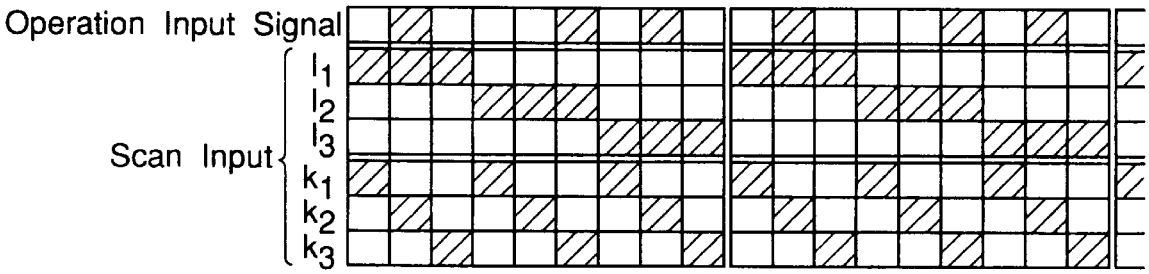
FIG. 15B is a timing chart of it.

When opening or closing, for example, the relay units in the hatched regions in FIG. 15A, upon applying a voltage according to an operation input signal pattern as shown in the timing chart of FIG. 15B, the relay units in the desired positions are operated similar to the aforementioned case. The other operation is similar to that of the aforementioned driving method, and therefore, no description is provided therefor.

As is apparent from the above description, according to the matrix relay of the present embodiment, the desired relay units can be independently driven by inputting the operation input signal according to a specified pattern.

Figure 16:
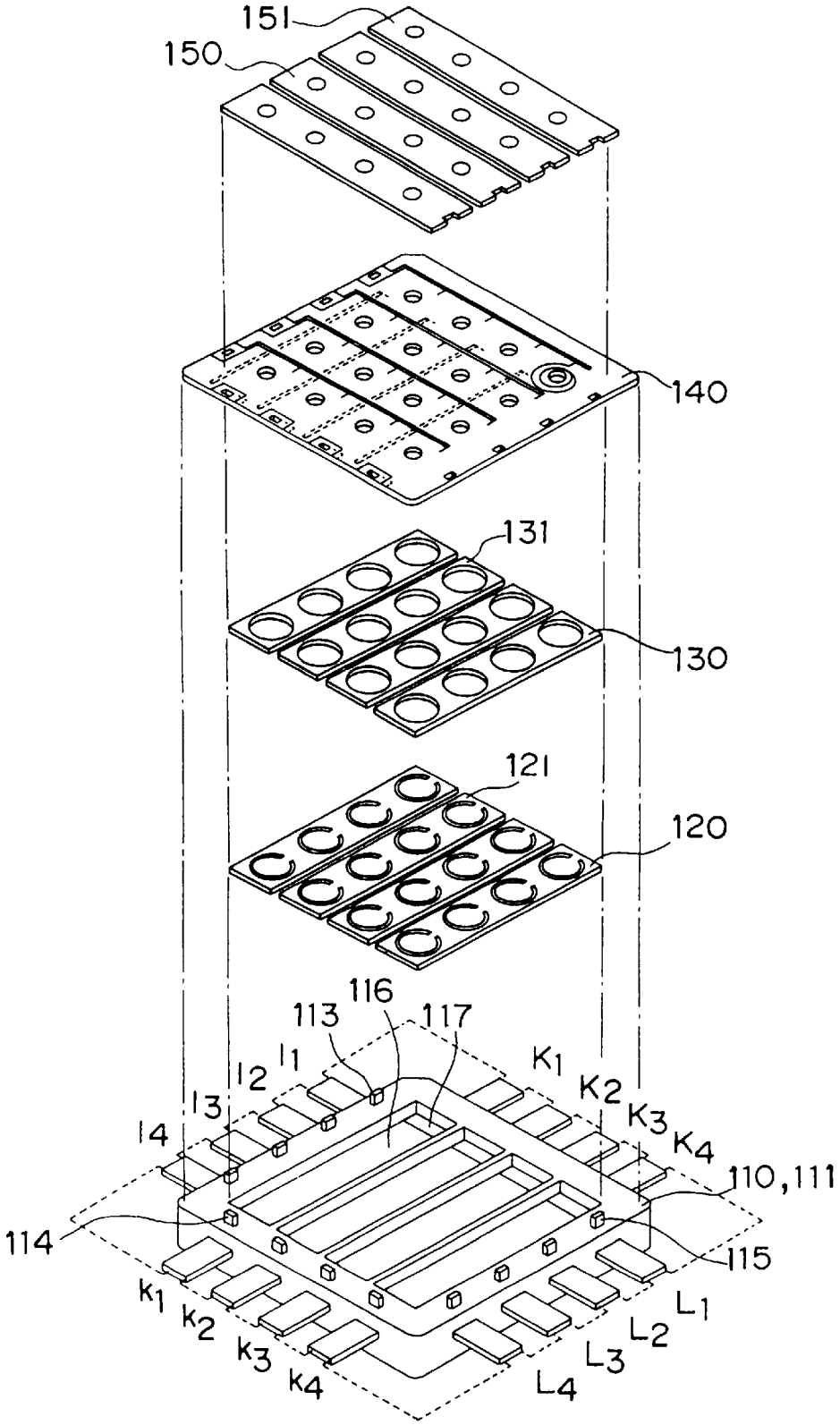
FIG. 16 is an exploded perspective view of a matrix relay according to a fifth embodiment of the present invention.

A fifth embodiment, as shown in FIG. 16, merely differs in the connection structures of the coil terminals l and k projecting from the upper surface of the opening edge portion of the base 110, the connecting terminal portions 113, 114 and 115 of the fixed contact terminal L and the movable contact terminal K, the coil plate 140 and the fixed contact plates 151 of the fixed contact unit 150, and the other structure is similar to that of the fourth embodiment. Therefore, no description is provided for it.

Figure 17:
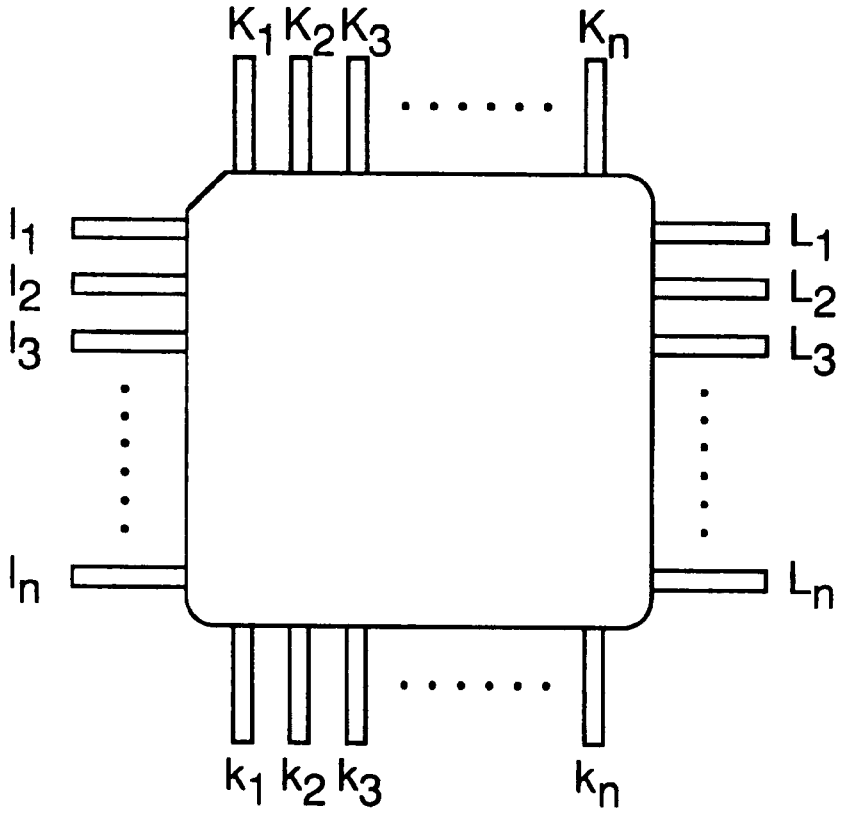
FIG. 17 is a plan view of a matrix relay according to a sixth embodiment of the present invention.
Figure 18A:
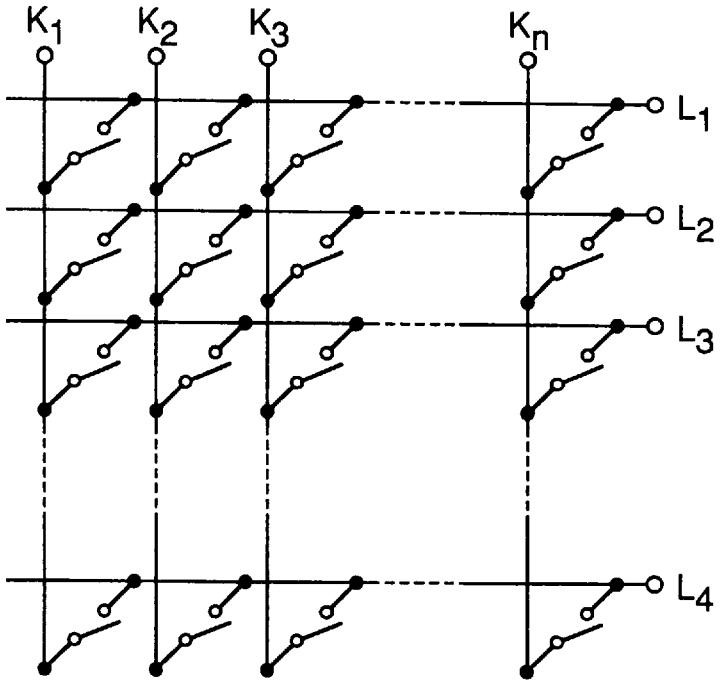
FIG. 18A is a circuit diagram of a contact section of the matrix relay shown in FIG. 17.
Figure 18B:
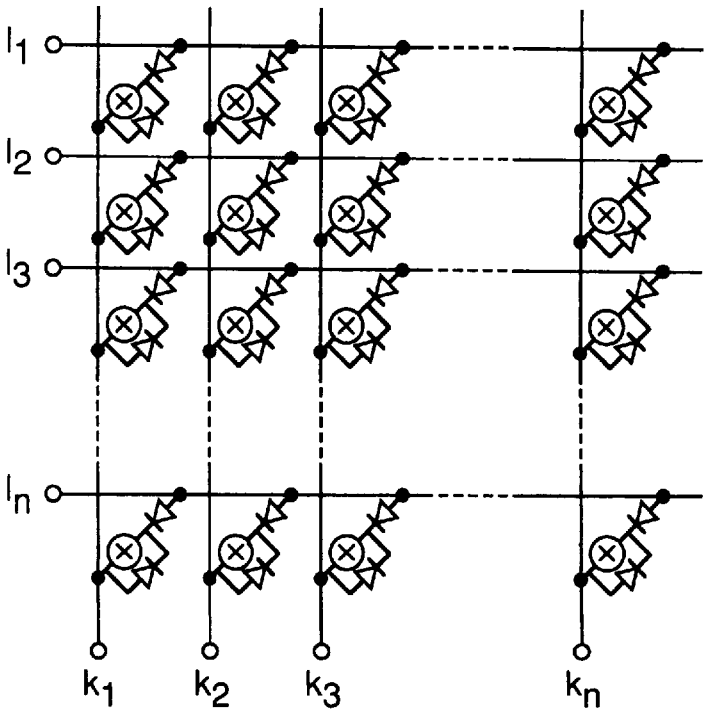
FIG. 18B is a circuit diagram of the coil section of it.

Although the aforementioned embodiments provide a matrix relay in which three or four longitudinal relay units by three or four lateral relay units are operated, the present invention is not limited to this, and there may be a matrix relay constructed of n longitudinal relay units by n lateral relay units as in a sixth embodiment shown in FIG. 17, FIG. 18A and FIG. 18B.

Furthermore, there may be a matrix relay comprised of relay units arranged in a line in a longitudinal direction or relay units arranged in a line in the lateral direction.

Furthermore, the present invention is not limited to the matrix relay and is, of course, allowed to be used as, for example, a matrix switch.

INDUSTRIAL APPLICABILITY

The aforementioned relay and matrix relay can be applied to a switch and a matrix switch.

What is claimed is:

1. A relay comprising:

a coil plate having a through hole formed therein;

at least one layer of a spiral flat coil formed around said through hole; and a moveable contact and a fixed contact which face each other so as to be able to come in and out of contact with each other via the through hole of the coil plate, said moveable contact being provided at a moveable contact piece pivotally supported in a direction of plate thickness via at least one hinge portion extending from inside an annular yoke for the formation of a movable contact plate, and said fixed contact being provided on one surface of a plate-like material for the formation of a fixed contact plate.

2. A relay as claimed in claim 1, wherein said movable contact plate is constructed so that the hinge portion is formed by providing a thin plate made of a conductive magnetic material with a slit having a C-figured planar shape, and the movable contact piece is divided from the annular yoke by the slit.

3. A relay as claimed in claim 1 or 2, wherein a supplementary yoke is held between the yoke of said movable contact plate and said coil plate.

4. A relay as claimed in claim 3, wherein an inner diameter of said supplementary yoke is greater than an outer diameter of said movable contact piece and smaller than an inner diameter of said yoke.

5. A relay as claimed in any one of claims 1 and 2, wherein the yoke of said movable contact plate is thicker than the movable contact piece and the hinge portion.

6. A relay as claimed in any one of claims 1 and 2, wherein said hinge portion is made to be a portion having a reduced thickness.

7. A relay as claimed in any one of claims 1 and 2, wherein said hinge portion is provided with a through hole.

8. A relay as claimed in claim 2, wherein both end portions of said slit extend inside the movable contact piece so as to form an elongated hinge portion.

9. A relay as claimed in any one of claims 1 and 2, wherein said fixed contact plate is tightly fixed to an insulating film provided on an upper surface of the coil plate, and a yoke of the movable contact plate is tightly fixed to an insulating film provided on a lower surface of the coil plate.

10. A relay as claimed in any one of claims 1 through 8, wherein said fixed contact plate is tightly fixed to an insulating film provided on an upper surface of the coil plate, and a yoke of the movable contact plate is tightly fixed to an insulating film provided on a lower surface of the coil plate via the supplementary yoke.

11. A relay as claimed in any one of claims 1 and 2, wherein a lower surface edge portion of the coil plate is integrated by bonding with an upper surface edge portion of a box-shaped base, and the movable contact plate is housed in a sealed space formed by sealing the through hole of the coil plate with the fixed contact plate.

12. A relay as claimed in any one of claims 1 and 2, wherein an insulating film is provided on a surface which belongs to the lower surface of said fixed contact plate and is bonded to the coil plate, and the coil plate and a box-shaped base are formed of a material identical to the material used for forming the insulating film.

13. A relay as claimed in any one of claims 1 and 2, comprising:

a box-shaped base where a movable contact terminal is exposed from its bottom corner portion and a coil terminal and an upper end portion of a fixed contact terminal are exposed from its upper surface edge portion;

a movable contact plate which is housed in the box-shaped base and electrically connected to said movable contact terminal;

a coil plate which is tightly fixed to the upper surface edge portion of said box-shaped base and has a flat coil electrically connected to an upper end portion of said coil terminal; and a fixed contact plate which is tightly fixed to an upper surface of the coil plate, has an iron core projected on its lower surface through a through hole of said coil plate and is electrically connected to an upper end portion of said fixed contact terminal.

14. A relay as claimed in claim 13, wherein the upper end portion of the coil terminal and the fixed contact terminal projecting from the upper surface edge portion of the box-shaped base are electrically connected in an engagement manner respectively to a corresponding terminal hole and a corresponding cut portion provided at the coil plate and the fixed contact plate.

15. A relay as claimed in claim 13, wherein the upper end portion of the coil terminal and the fixed contact terminal are exposed in flush with each other from the upper surface edge portion of the box-shaped base, the coil plate is electrically connected to the upper end portion of the coil terminal while being stacked on the coil terminal and the upper end portion of said fixed contact terminal is electrically connected to the fixed contact plate via an intermediate conductor provided at the coil plate.

16. A relay as claimed in claim 13, wherein the upper end portion of the coil terminal and the fixed contact terminal are exposed in flush with each other from the upper surface edge portion of the box-shaped base, the coil plate is electrically connected to the upper end portion of the coil terminal while being stacked on the coil terminal and a connecting stepped portion projected downward from an edge position of the fixed contact plate is electrically connected to the upper end portion of said fixed contact terminal while being directly bonded to the upper end portion.

17. A matrix relay comprising:

a coil plate having a plurality of through holes formed therein and provided in a matrix form on an insulative substrate on said coil plate;

at least one layer of spiral flat coils formed around at least one of said through holes; and movable contacts and fixed contacts which face each other so as to be able to come in and out of contact with each other via the through holes of the coil plate, said movable contacts being electrically connected together on every row for the formation of a movable contact unit, and said fixed contacts being electrically connected together along every column for the formation of a fixed contact unit.

18. A matrix relay as claimed in claim 17, wherein said fixed contacts are each projected on a fixed contact plate and arranged at a tip portion of an iron core which serves as a projecting section capable of penetrating said through hole.

19. A matrix relay as claimed in claim 17, wherein said movable contacts are provided at movable contact pieces provided parallel on the movable contact plate and are each arranged at a tip portion of a projecting section which can penetrate said through hole.

20. A matrix relay as claimed in any one of claims 17 through 19, wherein a supplementary yoke plate which is made of a magnetic material having a planar shape identical to that of said movable contact plate and is provided with a through hole slightly larger than that of said movable contact piece in a position corresponding to the movable contact piece is held between said movable contact plate and said coil plate.

21. A matrix relay as claimed in any one of claims 17 through 19, wherein said flat coil is connected to common connection lines which are provided parallel at a specified pitch on front and rear surfaces of said coil plate and cross in a matrix form.

22. A matrix relay as claimed in any one of claims 17 through 19, wherein a return delay element is connected parallel to each flat coil of said coil plate.

23. A matrix relay as claimed in any one of claims 17 through 19, wherein the flat coil of said coil plate is connected to said common connection line via reverse current preventing element connected in series with the flat coil.

24. A matrix relay as claimed in any one of claims 17 through 19, wherein said movable contact plates is fitted in each of a plurality of recessed portions arranged parallel on an upper surface of a base and one end portion of said movable contact plate is connected to a connecting end portion of the movable contact terminal exposed from a bottom corner portion of said recessed portion.

25. A matrix relay as claimed in any one of claims 17 through 19, wherein a coil terminal use connecting portion of said common connection line provided at a lower surface peripheral portion of said coil plate is connected to a connecting end portion of a coil terminal exposed at a specified pitch from an upper surface peripheral portion of the base.

26. A matrix relay as claimed in any one of claims 17 through 19, wherein one end portion of said fixed contact plate is connected to a connecting end portion of a fixed contact terminal exposed at a specified pitch from an upper surface peripheral portion of the base.

* * * * *